US006659738B2

(12) United States Patent
Iwanami et al.

(10) Patent No.: US 6,659,738 B2
(45) Date of Patent: Dec. 9, 2003

(54) COMPOSITE DRIVE SYSTEM FOR COMPRESSOR

(75) Inventors: Shigeki Iwanami, Okazaki (JP); Yukio Ogawa, Kariya (JP); Takashi Inoue, Nishio (JP); Hironori Asa, Nishio (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 9 days.

(21) Appl. No.: 10/074,242

(22) Filed: Feb. 14, 2002

(65) Prior Publication Data

US 2002/0110461 A1 Aug. 15, 2002

(30) Foreign Application Priority Data

Feb. 15, 2001 (JP) ..... 2001-038589
Jun. 8, 2001 (JP) ..... 2001-174660
Jul. 3, 2001 (JP) ..... 2001-202655

(51) Int. Cl.[7] ..... F04B 17/00; H02K 49/00
(52) U.S. Cl. ..... 417/374; 417/410.5; 310/103
(58) Field of Search ..... 417/212, 223, 417/410.5, 374; 310/103, 105; 464/29

(56) References Cited

U.S. PATENT DOCUMENTS 3,703,642 A * 11/1972 Balaguer ..... 290/43
3,985,468 A * 10/1976 Lewis ..... 417/214
4,769,993 A * 9/1988 Kawamura ..... 60/597
5,132,604 A * 7/1992 Shimane et al. ..... 322/10
5,675,203 A * 10/1997 Schulze et al. ..... 310/113
6,234,769 B1 * 5/2001 Sakai et al. ..... 417/374

FOREIGN PATENT DOCUMENTS

JP U-6-87678 12/1994
JP A-2000-229516 8/2000

* cited by examiner

*Primary Examiner*—Cheryl J. Tyler
*Assistant Examiner*—Timothy P. Solak
(74) *Attorney, Agent, or Firm*—Posz & Bethards, PLC

(57) ABSTRACT

A dynamotor capable of operating as either a motor or a generator is used with both the armature portion and the field portion thereof capable of being rotated. In the case where a pulley operatively interlocked with the output shaft of the prime mover is mounted on the rotary shaft of the armature portion, the drive shaft of the compressor is mounted on the rotating field portion. Once the dynamotor is operated in motor mode, the rotational speed of the compressor is increased to the sum of the input rotational speed and the rotational speed of the dynamotor. The compressor is stopped by disconnecting a power feed circuit. When the input rotational speed is too high, the dynamotor is operated in generator mode. In this way, the rotational speed is reduced in accordance with the generated electric energy.

34 Claims, 17 Drawing Sheets

COMPOSITE DRIVE SYSTEM FOR COMPRESSOR

BACKGROUND OF THE INVENTION

1. Field of the Invention

The present invention relates to a composite drive system, for a compressor, capable of rotationally driving the compressor selectively or at the same time by either of two drive sources including a prime mover such as an internal combustion engine and a motor rotated by the power of a battery.

2. Description of the Related Art

To cope with the environmental problems in recent years, the practical application of an idle-stop (or "eco-run") system has been promoted for stopping an internal combustion engine when a vehicle such as an automobile, with the engine mounted thereon, has stopped. When this system is used, as long as the vehicle is stationary, the compressor of the air-conditioning system of the particular vehicle also stops and the air-conditioning system is turned off, thereby causing the vehicle occupants to feel uncomfortable. In view of this, a "hybrid compressor" is known which can be driven by either of two drive sources. Specifically, while the vehicle is stationary, the drive source is switched from the internal combustion engine to a motor rotationally driven by the power stored in a battery thereby to drive a compressor.

As a first well-known example of the hybrid compressor, a system capable of driving a swash-plate compressor selectively by one of two drive sources, including an internal combustion engine and a battery, has been proposed. In this system, a pulley having an electromagnetic clutch widely used for an automotive air-conditioning system is mounted on the drive shaft of a swash-plate compressor with the discharge amount thereof variable for each rotation. This pulley is adapted to be rotationally driven by the internal combustion engine through a belt. On the other hand, a motor driven by battery power is mounted on the drive shaft of the same compressor. In the normal operating mode of this system, the compressor is driven by the internal combustion engine, and when it is foreseen that the time has come to stop the engine or switch the drive source of the compressor from the engine to the motor, the angle of inclination of the swash plate of the compressor, changing with the magnitude of the cooling load, is detected. In the case where the inclination angle is large, indicating that the cooling load is heavy, the deenergization of the electromagnetic clutch and the stopping of the internal combustion engine are delayed. Thus, the compressor continues to be driven by the internal combustion engine. In the case where the cooling load is light and, therefore, the inclination angle of the swash plate is small, on the other hand, the electromagnetic clutch is immediately deenergized while at the same time stopping the internal combustion engine. Thus, the compressor is driven by the motor.

In a second well-known example of the hybrid compressor described in Japanese Unexamined Utility Model Publication No. 6-87678, as in the first well-known example, the drive shaft of the swash-plate compressor is rotationally driven selectively by two drive sources, i.e. by an internal combustion engine connected to the drive shaft of the swash-plate compressor through a belt, a pulley and an electromagnetic clutch, or by a motor driven by the battery directly and connected with the drive shaft of the compressor. The feature of this conventional hybrid compressor lies in that, while the compressor is driven by the internal combustion engine, the same motor is used as a generator from which power is acquired and stored in a battery.

The first well-known example of the hybrid compressor poses the problems that a swash-plate compressor of a variable displacement type having a complicated structure is used to make the discharge capacity variable, that the motor is only an auxiliary drive source for driving the compressor temporarily while the internal combustion engine is out of operation and is useless in other points, that a complicated control operation is required in spite of the rather poor functions and effects, and that the pulley for receiving the power from the internal combustion engine is very bulky because the electromagnetic clutch and the motor are built inside of the pulley.

On the other hand, the problems of the second well-known example of the hybrid compressor are that a swash-plate compressor of a variable displacement type having a complicated structure is used to make the discharge capacity variable, and that an electromagnetic clutch and a motor are built inside the pulley in radially superposed positions and therefore the pulley is bulkier than that of the first well-known example of the hybrid compressor. In the second well-known example, however, the motor is used also as a generator. Therefore, although this motor is not a simple auxiliary drive source used selectively in coordination with the internal combustion engine, the additional function of the motor for power generation is undesirably overlapped with the operation of the generator for charging the battery always attached to the internal combustion engine. Also, the motor for power generation is not used in other than the season when the cooling system is operated, and therefore the generator attached to the internal combustion engine cannot be eliminated and replaced by the motor. Thus, the use of the motor for driving the compressor as a generator leads to no special advantage. Both of the conventional hybrid compressors described above, therefore, have no greater advantage than the basic functions and effects of selectively using two drive sources at the sacrifice of a complicated compressor structure and the resulting considerably increased volume of the compressor and the related component parts.

SUMMARY OF THE INVENTION

An object of the present invention is obviate the above-mentioned problems of the prior art and to provide an improved compact, lightweight composite drive system for a compressor which can be fabricated at low cost and has such a novel configuration that the discharge capacity per unit time can be changed over a wide range even when using a fixed displacement compressor of a simple structure having a predetermined discharge capacity per rotation instead of a variable displacement compressor having a complicated structure with an electromagnetic clutch.

Another object of the invention is to provide an improved composite drive system for a compressor, in which an electromagnetic clutch is not required even in the case where a variable displacement compressor is used and in which the whole system including the compressor and the input means receiving power from the prime mover and the motor for driving the compressor has a smaller size and weight than the conventional hybrid compressor.

According to one aspect of the invention, there is provided a composite drive system for a compressor which obviates the aforementioned various problems of the prior art in the manner described below (claim 1).

The composite drive system according to this aspect of the invention uses a dynamo-electric machine (hereinafter referred to as "the dynamotor") capable of operating both as a motor and as a generator and including a rotatable field portion and a rotatable armature portion, wherein a selected one of the armature portion and the field portion of the dynamotor is operatively interlocked with the output shaft of the prime mover, while the other one of the armature portion and the field portion is operatively interlocked with the drive shaft of the compressor. The dynamotor is connected with a power supply unit such as a battery through a power control unit.

In the case where the dynamotor is operated in motor mode by the power control unit, the turning effort of the output shaft of the prime mover received by selected one of the armature portion and the field portion of the dynamotor is output from the other one of the armature portion and the field portion as a turning effort having a higher rotational speed by adding the rotational speed generated between the armature portion and the field portion, as a motor, to the rotational speed received, so that the drive shaft of the compressor is driven by the particular turning effort. As a result, the discharge capacity per unit time of even a compact, lightweight compressor of fixed displacement type having a small discharge capacity per rotation can be freely controlled either upward or downward. In addition, when the prime mover is stationary, the compressor can be driven only by the dynamotor and the power supply unit, and in the case where the dynamotor is set in unloaded operation mode by disconnecting the dynamotor and the power supply unit, by the power control unit, the compressor can be stopped without using the electromagnetic clutch while the prime mover is in operation.

Further, in the event that the output rotational speed of the prime mover is excessively increased, the dynamotor is operated in generator mode by the power control unit, and by thus recovering the generated power to the power supply unit, the turning effort of the output shaft of the prime mover received from a selected one of the armature portion and the field portion of the dynamotor is partially converted into power and stored in the power supply unit. As a result, a reduced rotational speed is output from the other one of the armature portion and the field portion by adding the negative rotational speed generated between the armature portion and the field portion as a generator to the rotational speed received, so that the drive shaft of the compressor is driven by the motive power with an arbitrarily reduced rotational speed.

In this way, the wasteful consumption of energy is eliminated on the one hand and, even in the case where the rotational speed of the prime mover is excessively increased for the compressor of fixed displacement type, the discharge capacity per unit time of an arbitrary magnitude required of the compressor can be secured by freely controlling the rotational speed of the compressor on the other hand. Also, in the case where the power supply unit has no margin for receiving the power from the dynamotor, the rotational speed of the compressor can be regulated at the desired level, for example, by performing the duty factor control operation for switching between the unloaded operation mode and the generator mode at short time intervals.

According to another aspect of the invention, there is provided a composite drive system for a compressor which obviates the aforementioned various problems of the prior art in the manner described below (claim 6).

The composite drive system according to this aspect of the invention comprises a dynamotor capable of operating both as a motor and as a generator, and including a rotor having a plurality of permanent magnets on the peripheral surface thereof and an iron core having a plurality of coils and fixed at a position in opposed relation to the rotor. The dynamotor is connected to a power supply unit like a battery through a power control unit. A one-way clutch can be interposed between the rotor of the dynamotor and the input means receiving power from a prime mover constituting a main drive source.

In this dynamotor, the rotor is kept rotated as long as the prime mover constituting the main drive source such as an internal combustion engine is in operation. Therefore, the dynamotor is kept in generator mode and can always generate power as a generator, except when it is used in motor mode for driving the compressor in place of the main prime mover. This power is stored in the power supply unit through the power control unit. Even in the season when the compressor is not operated, therefore, the dynamotor operates as a generator.

A specific embodiment of the invention is the internal combustion engine mounted on a vehicle as a preferred prime mover. The compressor can be suitably used as a refrigerant compressor of an air-conditioning system of a vehicle. The battery mounted on the vehicle can be used as a power supply unit. In such a case, even when the internal combustion engine is stationary under idle-stop control, the air-conditioning system can be operated by driving the compressor using the dynamotor and the battery.

The use of the dynamotor of magnet type having at least a permanent magnet simplifies the structure, and therefore makes it possible to manufacture a compact, lightweight dynamotor at a lower cost. This is also true in the case where the dynamotor is incorporated in a driven pulley on the side of the compressor rotationally driven through a belt by the output shaft of a prime mover such as an internal combustion engine. In any case, the whole configuration of the composite drive system for the compressor can be reduced in size and weight, and can be easily built in a limited space such as the engine compartment of a vehicle.

BRIEF DESCRIPTION OF THE DRAWINGS

The above and other objects, features and advantages will be made apparent by the detailed description taken in conjunction with the accompanying drawings, in which.

DESCRIPTION OF THE PREFERRED EMBODIMENTS

Figure 1:
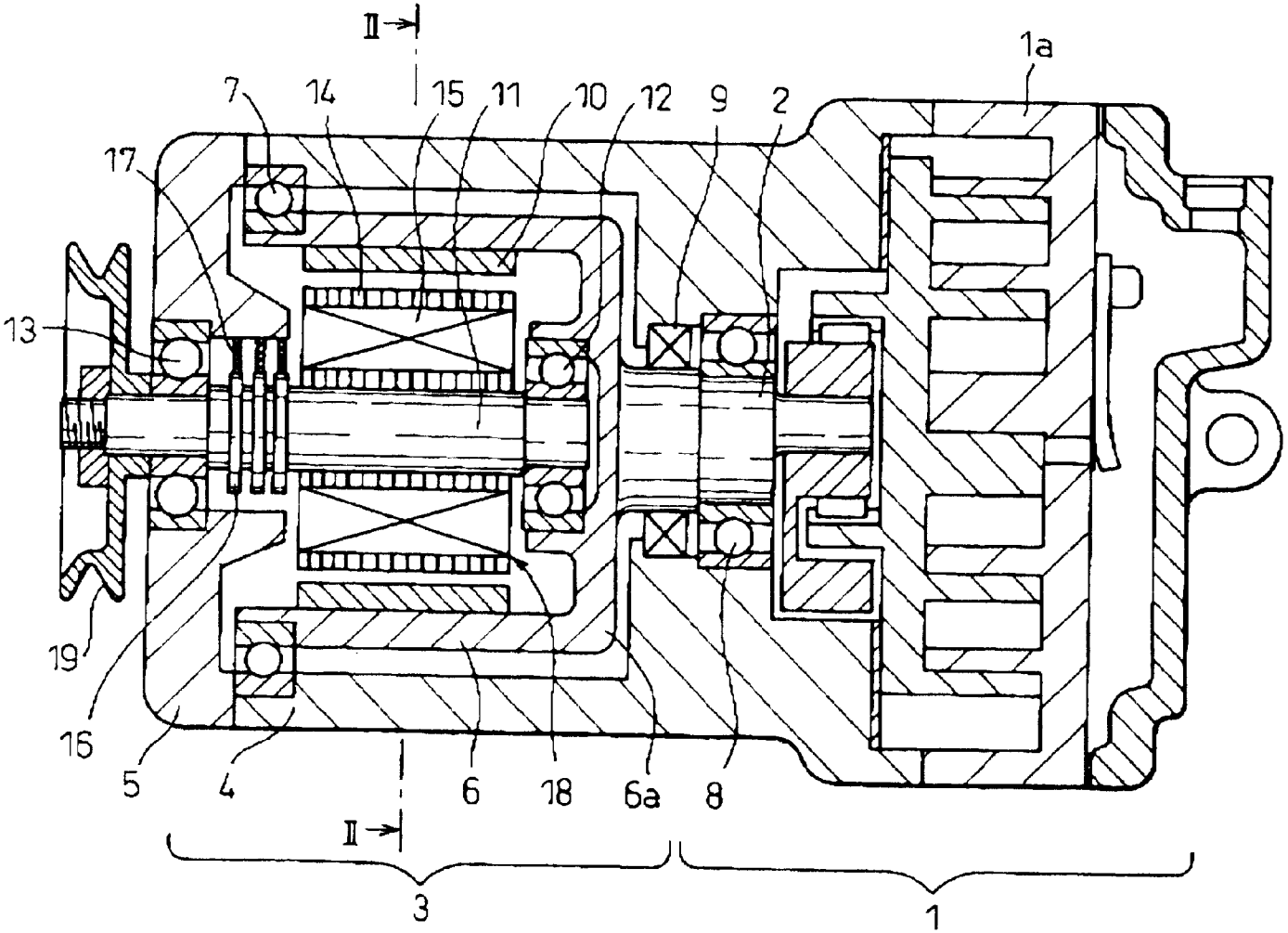
FIG. 1 is a longitudinal sectional view showing the essential parts of a first embodiment of the invention.

A composite drive system for a compressor according to a first embodiment of the invention will be explained with reference to FIGS. 1 to 6. As is apparent from FIG. 1, showing a longitudinal sectional view of the essential parts, a compressor 1 to be driven by the system is a scroll compressor having a well-known structure. Especially, this embodiment employs a compressor of fixed displacement type having no mechanism therein for changing the discharge capacity per rotation. The compressor 1 may be of a type other than a scroll compressor. The structure and operation of the scroll compressor are well known, and therefore will not be explained below. In short, the compressor 1 has a single drive shaft 2 for receiving the motive power and, when the drive shaft 2 is rotationally driven, it can compress a fluid such as a refrigerant circulated through the refrigeration cycle of an automotive air-conditioning system.

The discharge capacity per rotation of the compressor 1 may be normally about one half or one third of the normal discharge capacity. This is by reason of the fact that the composite drive system according to this invention can drive the compressor 1 at a higher speed than the rotational speed of the internal combustion engine, and therefore, even in the case where the discharge capacity per rotation is small as compared with that for the compressor driven only by the internal combustion engine, the discharge capacity per unit time is sufficiently large. The compressor 1 is of fixed displacement type and has a small discharge capacity per rotation, so that the size of the compressor 1 can be reduced remarkably as compared with the normal variable displacement compressor.

A substantially cylindrical housing 4 of a dynamotor 3 capable of operating both as a motor and as a generator is integrated with a housing la of the compressor 1. Reference numeral 5 designates a disk-shaped end plate for closing the front end of the housing 4 of the dynamotor 3. The disk-shaped end plate 5 is fastened to the housing 4 by a bolt or the like not shown. The drive shaft 2 of the compressor 1 extends into the internal space of the housing 4 of the dynamotor 3, and is mounted on the bottom surface 6*a* of a cup-shaped field portion 6 of the dynamotor 3. The field portion 5 is made of a magnetic material such as cast steel and is rotatably supported on a bearing 8 for supporting the bearing 7 in the housing 4 and the drive shaft 2 of the compressor 1. In this way, the field portion 6 of the dynamotor 3 has the feature that it can be rotated with respect to the fixed housing 4 unlike the normal motor or generator. This feature is not limited to the first embodiment but constitutes one of the basic features of the configuration according to the present invention. In FIG. 1, numeral 9 designates a shaft seal unit for hermetically sealing the internal space of the compressor 1 against the internal space of the dynamotor 3.

Figure 2:
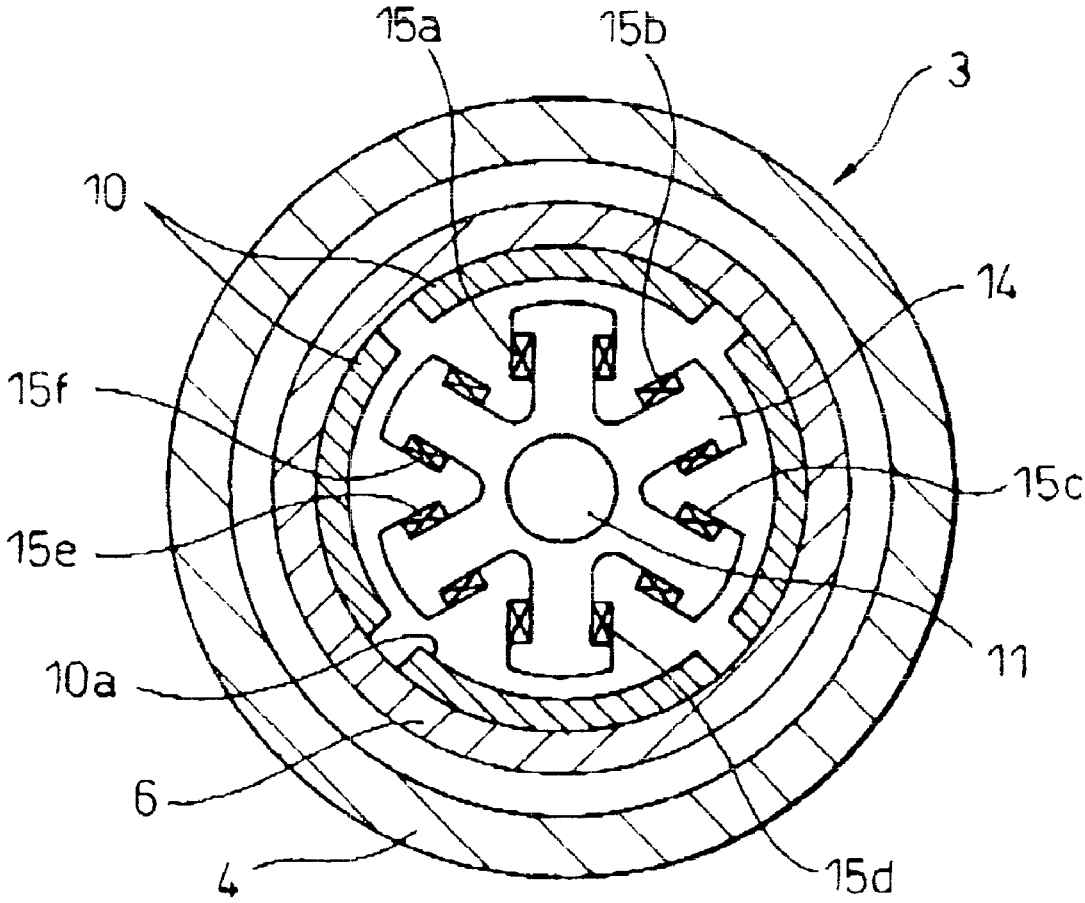
FIG. 2 is a cross sectional view showing the essential parts taken in line II—II in FIG. 1.
Figure 3:
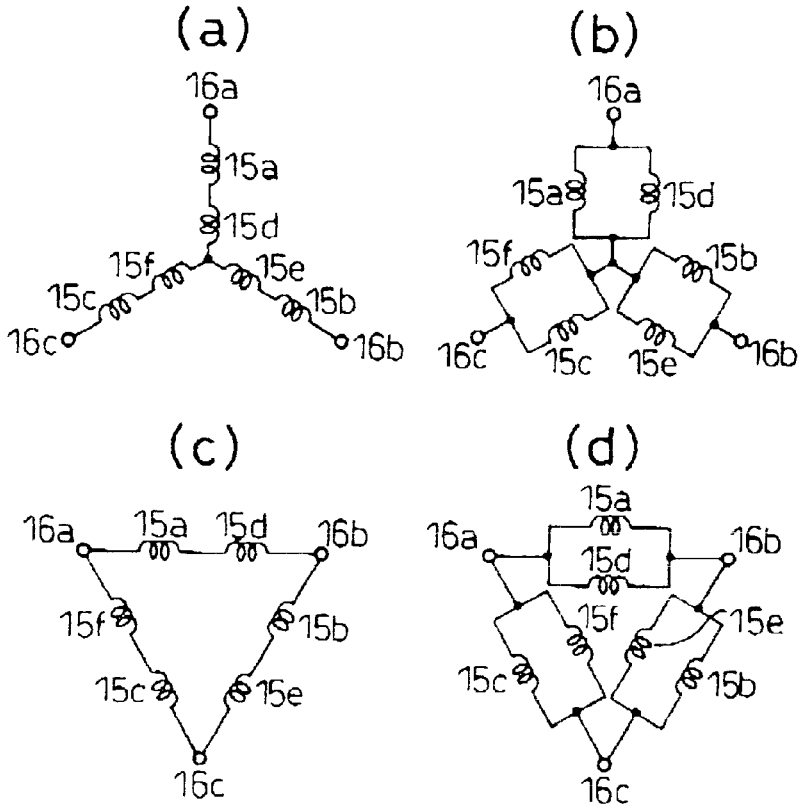
FIG. 3 includes connection diagrams (*a*) to (*d*) each for illustrating a method of connecting a plurality of coils of a three-phase AC dynamotor.

As is apparent, from not only FIG. 1 but also from FIG. 2 showing a cross sectional view taken in line II—II in FIG. 1, four permanent magnets 10 are mounted on the cylindrical inner surface of the field portion 6 of the dynamotor 3 in such positions as to divide the circumference into equal parts. A cylindrical field surface 10*a* is substantially formed by the inner surfaces of the four permanent magnets 10. The permanent magnets 10 according to the shown embodiment are each magnetized in the direction along the thickness (radial direction) thereof. Therefore, the N and S poles of the permanent magnets 10 are arranged along the circumference of the field surface 10*a* in such a manner that adjacent ones of the permanent magnets 10 are magnetized in opposite directions. However, this embodiment is not intended to limit the number, the direction of magnetization or the arrangement of the permanent magnets 10, for which an ordinary technique for the magnet motor or the magnet generator can be employed.

The rotary shaft 11 of the dynamotor 3 is rotatably supported by the bearing 12 arranged on the bottom surface 6*a* of the field portion 6 and the bearing 13 arranged at the end plate 5 of the housing 4 in such a manner as to coincide with the center axis of the field portion 6. As shown in FIG. 2, an iron core 14 having six radial protrusions at equal intervals are mounted on the rotary shaft 11 in such a manner as to form a slight gap with the field surface 10*a* of the permanent magnets 10. In this way, the iron core 14 can rotate with the rotary shaft 11 independently of the rotatable field portion 6. Each of the radial protrusions of the iron core 14 is wound with a coil 15.

Three slip rings 16 are mounted on the rotary shaft 11 through an insulating member. Brushes 17 mounted on the end plate 5 of the housing 4 through the insulating member are kept elastically in sliding contact with the slip rings 16, respectively. One end and the other end of each of the six coils 15*a* to 15*f* are connected to one of the slip rings 16*a* to 16*c* or one end or the other end of an adjacent one of the coils 15*a* to 15*f* in a predetermined manner. Four methods of connection are illustrated in (*a*) to (*d*) of FIG. 3. For actual practice of these connection methods, a well-known technique for an approximate dynamotor (a motor or a generator with the field portion fixed) can be referred to. In this specification, the iron core 14, the coil 15, etc. rotatable with the rotary shaft 11 are collectively called an armature portion 18 as against the rotatable field portion 6.

Figure 4:
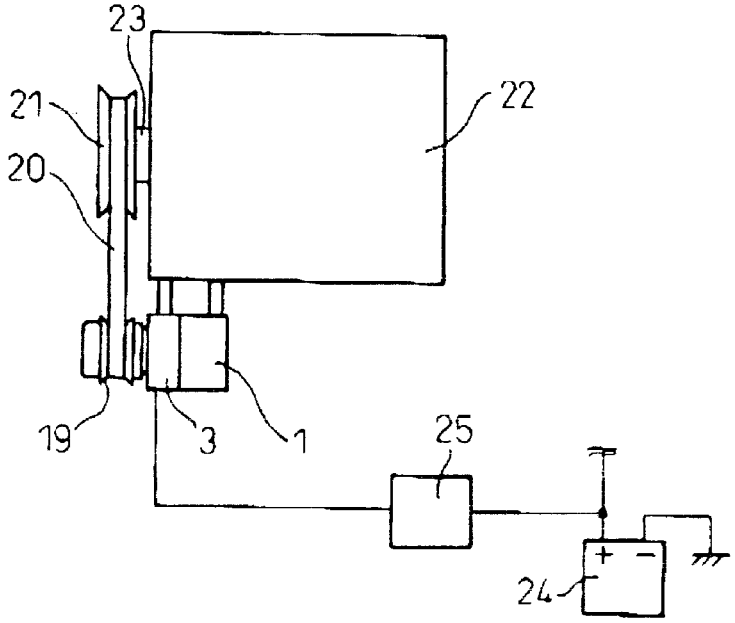
FIG. 4 is a schematic diagram illustrating a general configuration of a composite drive system for a compressor according to the invention.

FIG. 4 is a diagram schematically showing a general configuration of the composite drive system for the compressor according to a first embodiment. A pulley (input means) 19 mounted on the front end of the rotary shaft 11 of the dynamotor 3 is operatively interlocked with a mating pulley 21 through a belt 20. The pulley 21 is mounted on the output shaft 23 such as the crankshaft of an internal combustion engine (a prime mover in general terms) 22 mounted as a main drive source on the vehicle. Numeral 24 designates a power supply unit such as a battery mounted on the vehicle. As described later, the power supply unit 24 can supply power to the dynamotor 3 when the dynamotor 3 operates as a motor in motor mode, while the power supply unit 24 can receive and store power from the dynamotor 3 when the dynamotor 3 operates as a generator in generator mode. The battery 24 is charged also by another generator, not shown, rotationally driven by the internal combustion engine 22. As long as the dynamotor 3 can supply a sufficient amount of power, however, the dynamotor 3 can act as a main generator for the vehicle.

Various control operations are required. They include the switching of the two operating modes, i.e. the motor mode and the generator mode of the dynamotor 3, the conversion or rectification between the DC power and the three-phase AC power, and the circuit disconnection for cutting off the current flow between the dynamotor 3 and the battery 24. In view of these needs, a power control unit, 25 including a computer and an electrical circuit for executing commands from the computer, is interposed between the battery 24 and the dynamotor 3. Example configurations of the power control unit 25 will be specifically explained later.

According to the first embodiment, when the dynamotor 3 is set in motor mode by the power control unit 25, the DC power supplied from the battery 24 is converted by the power control unit 25 into the three-phase AC power and supplied to the three brushes 17 of the dynamotor 3. In the case where the dynamotor 3 is set in generator mode, in contrast, the three-phase AC power generated by the rotational drive of the dynamotor 3 is rectified by the power control unit 25 and supplied as DC power to the battery 24 and stored in the battery 24 together with the power generated by the generator normally incorporated in the internal combustion engine 22. In the case where the compressor 1 is used as a refrigerant compressor in the refrigeration cycle of the automotive air-conditioning system, for example, the above-mentioned operation of the power control unit 25 is automatically started upon turning on of the operating switch of the automotive air-conditioning system.

The composite drive system for the compressor 1 according to the first embodiment is configured as described above. As long as the internal combustion engine 22 is in operation, therefore, the turning effort thereof is transmitted to the output shaft 23, the pulley 21, the belt 20 and the pulley 19, in that order, thereby to rotate the rotary shaft 11 and the armature portion 18 of the dynamotor 3 shown in FIG. 1. In the case where no current flows between the power control unit 25 and the dynamotor 3 under this condition, the iron core of the armature portion 18 having the coils 15 is not magnetized, and therefore substantially fails to apply the force to the field portion 6 having the permanent magnets 10. Thus the armature portion 18 is simply activated in unloaded state, while the field portion 6 and the drive shaft 2 of the compressor 1 are not rotated. Taking advantage of this operation of the dynamotor 3 in an unloaded mode, the electromagnetic clutch for deactivating the compressor 1 when the air-conditioning system is not required and can be eliminated in the case where the compressor 1 is used as a refrigerant compressor of the air-conditioning system. As a result, the composite drive system can be reduced in size and weight and can be manufactured at a lower cost.

For operating the air-conditioning system, the compressor 1 is activated, in which case the power control unit 25 switches the dynamotor 3 to motor mode. As described later, the power control unit 25 includes a computer for issuing control commands and a circuit for executing the commands. This circuit has the function of a switch, the function of an inverter and the function of a rectifier. Once the computer designates the operation in motor mode, therefore, the power control unit 25 converts the DC power of the battery 24 into the three-phase AC power and supplies it to the brushes 17 of the dynamotor 3. This power is supplied to the coils 15 of the armature portion 18 through the slip rings 16, and therefore a rotary magnetic field is formed around the rotary shaft 11 on the armature portion 18. As a result, the field portion 6 having the permanent magnets 10 and the armature portion 18 that has generated the rotary magnetic field rotate relatively to each other for generating the attracting force and the repulsive force in the direction along the circumference (along the tangential direction), so that the dynamotor 3 operates as a motor. According to the first embodiment, the output of the dynamotor 3 as a motor is produced from the field portion 6 in rotation. Thus, the turning effort of the field portion 6 is transmitted to the compressor 1 through the drive shaft 2, so that the compressor 1 compresses a refrigerant or the like fluid.

According to the first embodiment, the rotary shaft 11 and the armature portion 18 of the dynamotor 3 are rotationally driven by the internal combustion engine 22 through the pulley 19, and the field portion 6 of the dynamotor 3 operating as a motor is rotated, at a higher speed than the armature portion 18, with the aid of the armature portion 18. If the difference between the rotational speed on the output side less the rotational speed on the input side of the dynamotor 3, i.e. the relative rotational speed between the armature portion 18 and the field portion 6, which is a rotational speed derived from the dynamotor 3 alone, is defined as "the rotational speed $\Delta N$ of the dynamotor 3" then, as long as the dynamotor 3 is operating in motor mode, $\Delta N$ assumes a positive value. In this case, as a matter of course, the rotational speed of the drive shaft 2 constituting the rotational speed of the compressor 1 is given as the sum of the rotational speed of the rotary shaft 11 (i.e. the rotational speed of the pulley 19) and the rotational speed $\Delta N$ of the dynamotor 3.

The value of this sum is, of course, changed steplessly even in the case where the rotational speed of the rotary shaft 11 is changed with the change of the rotational speed of the internal combustion engine 22 or even in the case where the rotational speed $\Delta N$ of the dynamotor 3 is changed by controlling the three-phase AC electric energy supplied to the dynamotor 3. In the case of a vehicle, the rotational speed of the internal combustion engine 22 changes in accordance with the vehicle running condition, and the rotational speed of the internal combustion engine 22 cannot, generally, be changed for the sole purpose of controlling the air-conditioning system. For changing the cooling capacity of the air-conditioning system, therefore, the rotational speed $\Delta N$ of the dynamotor 3 must be changed.

The dynamotor 3 according to the first embodiment is of three-phase AC type. For changing the rotational speed $\Delta N$ of the dynamotor 3, therefore, the frequency of the three-phase AC power supplied is changed under the control of the power control unit 25. As a result, the rotational speed of the rotary magnetic field of the armature portion 18 changes and so does the value of $\Delta N$. The magnitude of the torque generated by the dynamotor 3 operating as a motor is changed also in the case where the current amount is changed by changing the voltage applied to the dynamotor 3 and thus changing the electric energy supplied, while at the same time maintaining the frequency of the three-phase AC power supply constant. As related to the magnitude of the load torque of the compressor 1 changing in accordance with the cooling load of the air-conditioning system, therefore, the slip rate of the dynamotor 3, i.e. the degree to which the rotation of the field portion 6 is delayed with respect to the rotation of the rotary magnetic field of the armature portion 18 is changed thereby to change ΔN, resulting in the change in the rotational speed of the drive shaft 2 of the compressor 1. It is thus possible to control the rotational speed of the drive shaft 2 also by this method.

As described above, in the case where the dynamotor 3 is set in motor mode by the power control unit 25, the rotational speed ΔN of the dynamotor 3 defined above is added to the rotational speed of the pulley 19 due to the internal combustion engine, and therefore the rotational speed of the drive shaft 2 is increased beyond the rotational speed of the pulley 19. Even in the case where the discharge capacity per rotation of the compressor 1 is small, therefore, the discharge capacity per unit time is increased due to the high rotational speed. Even the use of the compressor 1 smaller in size and weight than the conventional compressor and having a discharge capacity per rotation as small as one half or one third that of the conventional compressor can secure the required discharge capacity per unit time. Also, the discharge capacity per unit time of the compressor 1 and the cooling capacity of the air-conditioning system can be changed steplessly by controlling the frequency or the electric energy of the power supplied to the dynamotor 3 by the power control unit 25 and thereby changing the rotational speed ΔN of the dynamotor 3.

As apparent from the foregoing description, the discharge capacity per unit time of the compressor 1 and hence the cooling capacity of the air-conditioning system can be calculated as follows:

Discharge capacity per unit time=(rotational speed of rotary shaft 11+rotational speed ΔN of dynamotor 3)× (discharge capacity per rotation of compressor 1)

Also in the case where the air-conditioning system is operated only with the power of the battery 24 when the internal combustion engine 22 is stopped by idle-stop control, for example, the power control unit 25 selects the motor mode for the dynamotor 3. In this case, the pulley 19 and the rotary shaft 11 are stopped with the internal combustion engine 22, and therefore the rotational speed ΔN of the dynamotor 3 itself constitutes the rotational speed of the drive shaft 2 of the compressor 1. Also in this case, the cooling capacity of the air-conditioning system can be adjusted to an arbitrary level by changing the frequency of the three-phase AC power supplied to the dynamotor 3 and thus changing the rotational speed of the drive shaft 2 freely and under the control of the power control unit 25.

As is apparent from the foregoing description, with the composite drive system according to the invention, the rotational speed ΔN of the dynamotor 3 is added to the rotational speed of the pulley 19 (rotary shaft 11) driven by the internal combustion engine 22 when the dynamotor 3 is in motor mode. Therefore, the rotational speed of the drive shaft 2 of the compressor 1 is higher than in the prior art in which the compressor is driven by the internal combustion engine alone. In the case where the discharge capacity of the compressor 1 becomes excessively high and exceeds the required discharge capacity of the compressor 1, therefore, the generator mode is selected by the power control unit 25. By thus operating the dynamotor 3 as a generator, the discharge capacity of the compressor 1 can be reduced smoothly and steplessly.

Upon selecting the generator mode of the dynamotor 3, by a computer incorporated in the power control unit 25 or arranged externally, the power control unit 25 switches the related electrical circuit. Thus, the direction of flow of the power that has thus far been supplied to the dynamotor 3 from the battery 24 is reversed, and the power is supplied toward the battery 24 from the dynamotor 3 and stored in the battery 24. For this to be achieved, the DC voltage after rectification of the three-phase AC current generated by the dynamotor 3 as a generator is of course required to be set to a level higher than the terminal voltage of the battery 24.

As soon as the dynamotor 3 begins to operate as a generator for charging the battery 24 under the control of the power control unit 25, the motive power supplied from the internal combustion engine 22 through the belt 20 and the pulley 19 to the rotary shaft 11 is consumed by both the dynamotor 3 and the compressor 1. If the rotational speed of the rotary shaft 11 dependent on the internal combustion engine 22 is constant, the amount of the motive power applied to the rotary shaft 11 by the internal combustion engine 22 is considered to be constant. Once the consumption of the motive power of the dynamotor 3 as a generator is increased, therefore, the amount of motive power that can be consumed by the compressor 1 is reduced correspondingly.

When the discharge capacity of the compressor increases excessively, therefore, the power-generating capacity of the dynamotor 3 as a generator is increased by the power control unit 25. As a result, even in the case where the rotational speed of the rotary shaft 11 is constant, the amount of motive power consumed by the dynamotor 3 increases, so that both the amount of power generated and the amount of current charged to the battery 24 are increased. Conversely, the amount of motive power consumed by the compressor 1 decreases so that both the refrigerant discharge capacity of the compressor 1 and the cooling capacity of the air-conditioning system are decreased. This is because the increased power generation load of the dynamotor 3 increases the delay of rotation of the field portion 6 following the armature portion 18, and the resulting increase in the difference between them reduces the rotational speed of the drive shaft 2 of the compressor 1.

As described above, with the composite drive system for the compressor according to the first embodiment of the invention, the rotational speed of the compressor 1 can be controlled freely over a wide range from stationary state to high-speed rotation without using the electromagnetic clutch or the transmission. For this reason, various superior advantages are achieved. Specifically, the discharge capacity per unit time of the compressor 1 can be changed freely and smoothly in accordance with the cooling load, and even when the internal combustion engine 22 is stopped, the operation of the compressor 1 and the air-conditioning system can be continued by the power of the battery 24. Also, in view of the fact that the battery 24 is charged when the system is in generator mode, the energy is not wastefully consumed, and the compressor 1 can be reduced in both size and weight. Further, even in the case where the compressor 1 is of a fixed displacement type having a predetermined discharge capacity per rotation and a simple structure, an effect can be achieved similar to that of the expensive variable displacement compressor having a complicated structure. Furthermore, the operation of the dynamotor 3 in an unloaded operation mode eliminates the need of the electromagnetic clutch, and the size of the whole system including the compressor 1 and the dynamotor 3 can be reduced as compared with the conventional system.

Figure 5:
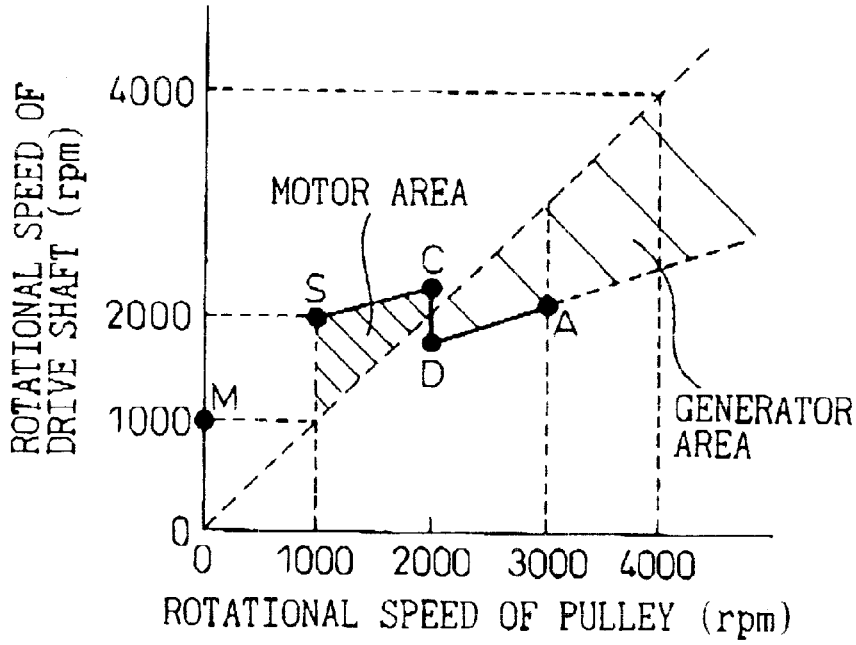
FIG. 5 is a diagram for explaining the operation of the dynamotor according to the invention.

In addition to the qualitative description made above of the operation and effects of the composite drive system for the compressor according to the first embodiment of the invention as a typical example, a further explanation will be made specifically based on numerical values with reference to FIGS. 5 and 6. The diagram of FIG. 5 shows the condition for the operation of the air-conditioning system only by the power of the battery 24 when the internal combustion engine 22 is stationary, and the condition for the operation of the air-conditioning system with the cooling capacity thereof controlled over a wide range when the internal combustion engine 22 is in operation. The abscissa represents the rotational speed of the pulley 19 and the rotary shaft 11 of the dynamotor 3 (i.e. the rotational speed of the armature portion 18), which changes in proportion to the rotational speed of the output shaft 23 of the internal combustion engine 22. The ordinate represents the rotational speed of the drive shaft 2 of the compressor 1, which is identical to the rotational speed of the field portion 6 according to the first embodiment.

When the internal combustion engine 22 is stationary, the motor mode is selected by the power control unit 25, and the power of the battery 24 is converted to the three-phase AC power and supplied to the dynamotor 3. As a result, the dynamotor 3 is operated as a motor, so that the field portion 6 and the drive shaft 2 of the compressor 1 are rotated at the same rotational speed ΔN as the dynamotor 3, say, at 1,000 rpm, as indicated by point M in FIG. 5. The figure of 1,000 rpm of course is only illustrative, and the rotational speed ΔN may alternatively be 1,500 rpm or 2,000 rpm. The rotational speed ΔN can be changed freely by changing the frequency of the three-phase AC power supplied. In this way, the compressor 1 is rotationally driven by the dynamotor 3 in motor mode and the air-conditioning system can be operated with an arbitrary magnitude of the cooling capacity when the internal combustion engine 22 is stopped.

When the internal combustion engine 22 is started and the idling thereof causes the pulley 19 and the rotary shaft 11 to rotate at, for example, 1,000 rpm, on the other hand, the rotational speed of the drive shaft 2 is the sum of the rotational speed of the rotary shaft 11 (i.e. the rotational speed of the pulley 19) and the "rotational speed ΔN of the dynamotor 3", as described above. Therefore, the drive shaft 2 of the compressor 1 rotates at 2,000 rpm as indicated by point S in FIG. 5. Thereafter, even in the case where the rotational speed ΔN is maintained at a constant 1,000 rpm, the rotational speed of the drive shaft 2 increases with the rotational speed of the internal combustion engine 22. An excessive increase in the rotational speed of the drive shaft 2, however, would excessively increase the cooling capacity of the air-conditioning system and waste the motive power. In compliance with the instruction from the computer, therefore, the power control unit 25 automatically switches the dynamotor 3 to generator mode.

Once the dynamotor 3 has begun to operate as a generator, the rotational speed of the drive shaft 2 of the compressor 1 is decreased in accordance with the magnitude of the motive power consumed by the dynamotor 3 as described above. This change is indicated as the translation from point C to point D in FIG. 5. In the diagram of FIG. 5, the portion above the straight line extending rightward up at 45° represents the motor area corresponding to the motor mode of the dynamotor 3, and the portion below the same straight line indicates the generator area corresponding to the generator mode of the dynamotor 3.

Also, when the system is in generator mode, the rotational speed of the drive shaft 2 of the compressor 1 is given as the sum of the rotational speed of the rotary shaft 11 (i.e. the rotational speed of the pulley 19) and the rotational speed ΔN of the dynamotor 3 defined earlier. In generator mode, however, the rotational speed on the output side (field portion 6) is lower than the rotational speed on the input side (rotary shaft 11), and therefore the "rotational speed ΔN of the dynamotor 3" defined as the difference between the rotational speeds on input and output sides assumes a negative value. Thus, the rotational speed of the rotary shaft 11 is reduced by ΔN and transmitted to the field portion 6 and the drive shaft 2 of the compressor 1. At this point, the negative rotational speed of the dynamotor 3 is changed by controlling the amount of the current flowing in the coils 15 of the dynamotor 3. Then, even though the rotational speed of the internal combustion engine 22 and hence the pulley 19 remains the same, the rotational speed of the drive shaft 2 changes steplessly, so that the discharge capacity of the compressor 1 and the cooling capacity of the air-conditioning system can be changed steplessly.

Even in the case where the rotational speed of the drive shaft 2 is reduced by controlling the amount of the three-phase AC current flowing in the coils 15 of the dynamotor 3 in generator mode and thus increasing the absolute value of the rotational speed ΔN of the dynamotor 3 assuming a negative value, however, the rotational speed of the drive shaft 2 of the compressor 1 is still increased if the rotational speed of the internal combustion engine 22 increases greatly. In the event that the rotational speed of the drive shaft 2 exceeds the upper limit of the preferred rotational speed range indicated by point A in FIG. 5 and may further increase along the dashed line, for example, the function to suppress the rotational speed by setting the operation of the dynamotor 3 in generator mode may reach the limit and may be incapable of working effectively any longer. This situation occurs, for example, in a case where the battery 24 is charged to 100% of the capacity thereof and has no margin to receive the power from the dynamotor 3 in generator mode.

Figure 6:
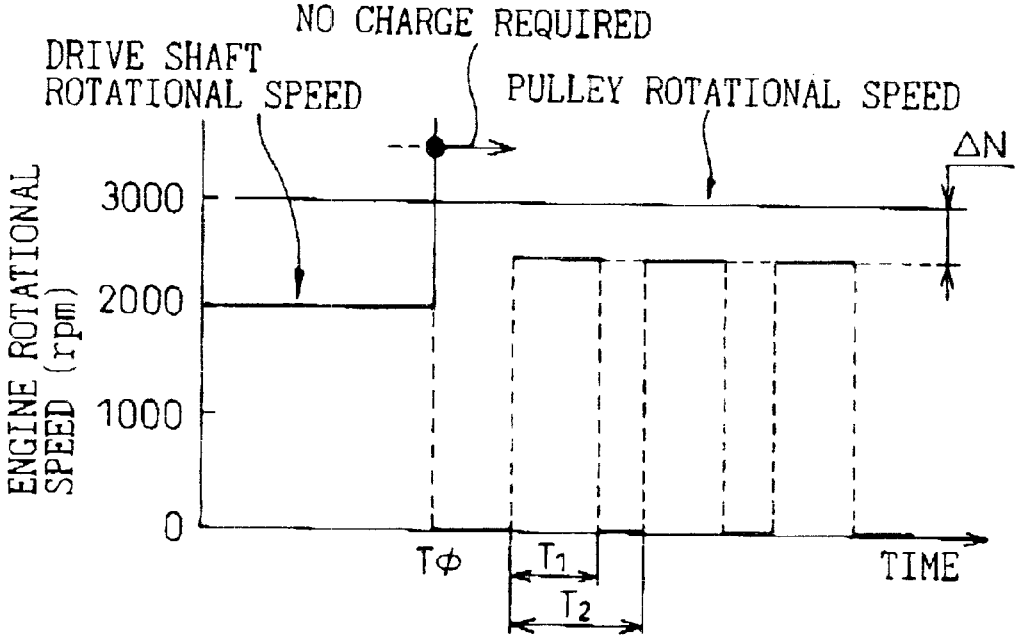
FIG. 6 is a time chart for explaining the duty factor control operation according to the invention.

This situation can be met by controlling the duty factor as shown in FIG. 6. Specifically, at the time Tϕ at point A in FIG. 5 where the rotation speed of the pulley 19 is 3,000 rpm and the rotational speed of the drive shaft 2 of the compressor 1 is 2,000 rpm, the power control unit 25 disconnects the dynamotor 3 and the battery 24 from each other only for a short time. As a result, the current ceases to flow in the coils 15 of the dynamotor 3. Therefore, the dynamotor 3 turns to unloaded operation mode in which the compressor 1 is not driven, and the rotational speed of the drive shaft 2 indicated by a solid horizontal line is decreased toward zero. Upon the lapse of the predetermined short time, the power control unit 25 reconnects the dynamotor 3 and the battery 24 for a short time to return the dynamotor 3 to generator mode. Thus, the rotational speed of the drive shaft 2 approaches the rotational speed of the pulley 19 at 3,000 rpm as indicated by a thin horizontal line. However, this state lasts only for a short time T1 after which the coils 15 are deenergized again. By repeating the unloaded operation mode and the generator mode at short time intervals in this way, the on-off control operation is performed with the duty factor T1/T2. Thus, the abnormal increase in the rotational speed of the drive shaft 2 and the resulting otherwise excessive cooling capacity can be suppressed even in the case where the battery 24 is fully charged.

In this case, if the rotational speed of the drive shaft 2 of the compressor 1 reaches exactly the same level of 3,000 rpm as that of the pulley 19, the motive power of the dynamotor 3 would cease to be transmitted. Therefore, the minimum difference of "the rotational speed ΔN of the dynamotor 3" is required between the rotational speed of the drive shaft 2 and that of the pulley 19. The power generating ability of the dynamotor 3 can be maintained unless the value ΔN is zero, no matter however small it may be. Therefore, the value ΔN is minimized to reduce the electric energy supplied to the battery 24 while at the same time adjusting the discharge capacity of the compressor 1 by controlling the duty factor.

As described above, the present invention has the feature that the discharge capacity per unit time is increased and the discharge capacity can be controlled over a wide range by using the compressor 1 of a smaller capacity and driving the same compressor 1 with the small dynamotor 3 at a higher speed. Nevertheless, in the case where the size of the dynamotor 3 can be increased to generate a larger motive power, the compressor 1 of normal size may be used and the dynamotor 3 may be operated frequently in generator mode, thereby consuming most of the time for charging the battery 24.

Figure 7:
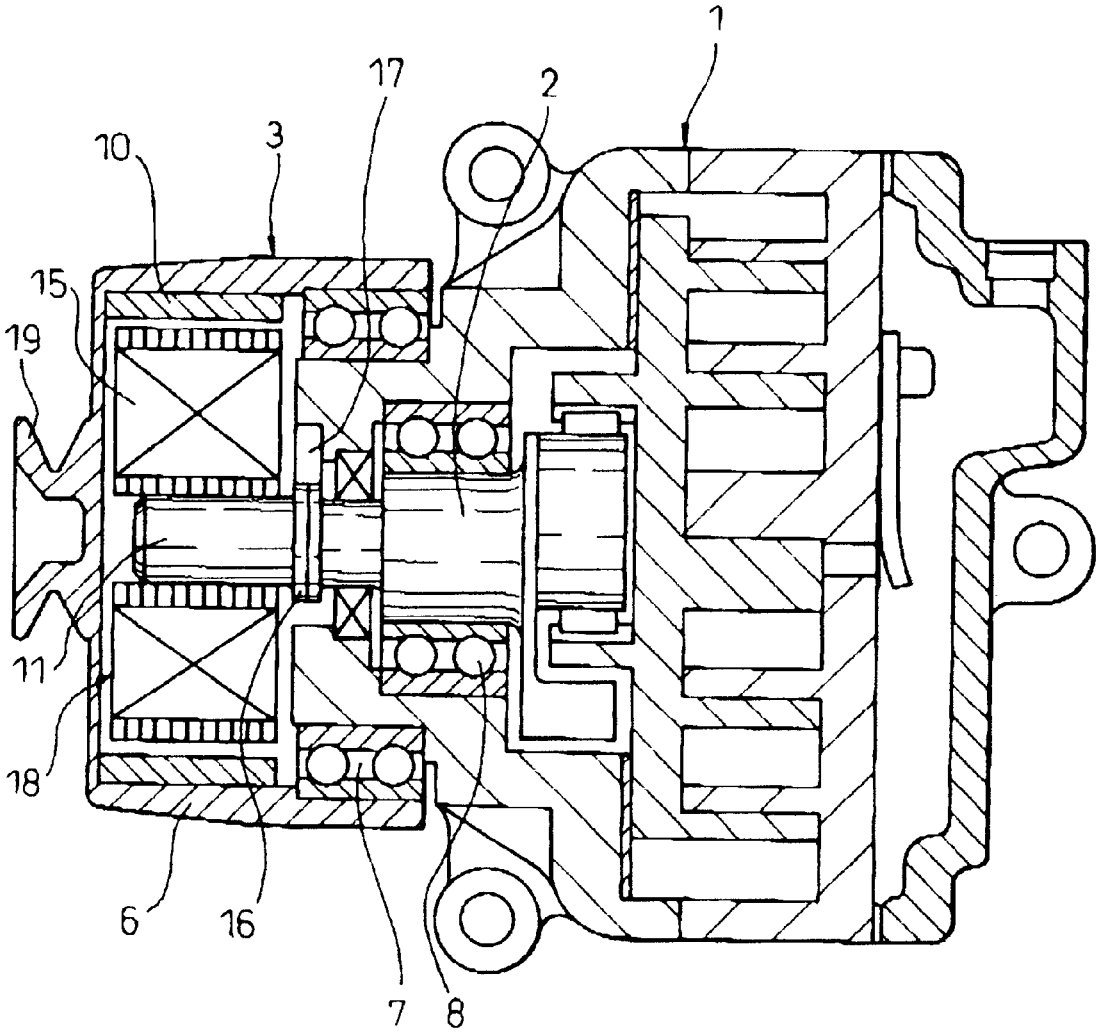
FIG. 7 is a longitudinal sectional view showing the essential parts according to a second embodiment of the invention.

FIG. 7 shows the essential parts of a composite drive system of a compressor according to a second embodiment of the invention. The second embodiment is different substantively from the first embodiment shown in FIG. 1 in that the pulley 19 has a smaller diameter and makes up a mechanism for transmitting a higher speed in a predetermined relation with the diameter of the pulley 21 shown in FIG. 4, and that the rotating field portion 6 of the dynamotor 3 doubles as a housing integrated with the pulley 19 thus constituting the input side of the dynamotor 3 while the armature portion 18 constitutes the output side of the dynamotor 3 correspondingly, so that the rotary shaft 11 of the dynamotor 3 is integrated with the drive shaft 2 of the compressor 1. The other points are similar to the corresponding points of the first embodiment.

As in the second embodiment, even in the case where the field portion 6 is rotationally driven by the internal combustion engine 22, the rotational speed equal to the sum of the rotational speed of the pulley 19 and the rotational speed ΔN of the dynamotor 3 can be similarly acquired from the armature portion 18. In this case, ΔN is a value equal to the rotational speed of the armature portion 18 on the output side less the rotational speed of the filed unit 6 on the input side, and similarly assumes a positive value in motor mode and a negative value in generator mode. In the second embodiment, as compared with the first embodiment, the pulley 19 itself is driven at a higher speed, and therefore the discharge capacity per unit time is increased for the same small capacity of the compressor 1. The other functions and effects of the second embodiment are similar to the corresponding ones of the first embodiment.

Figure 8:
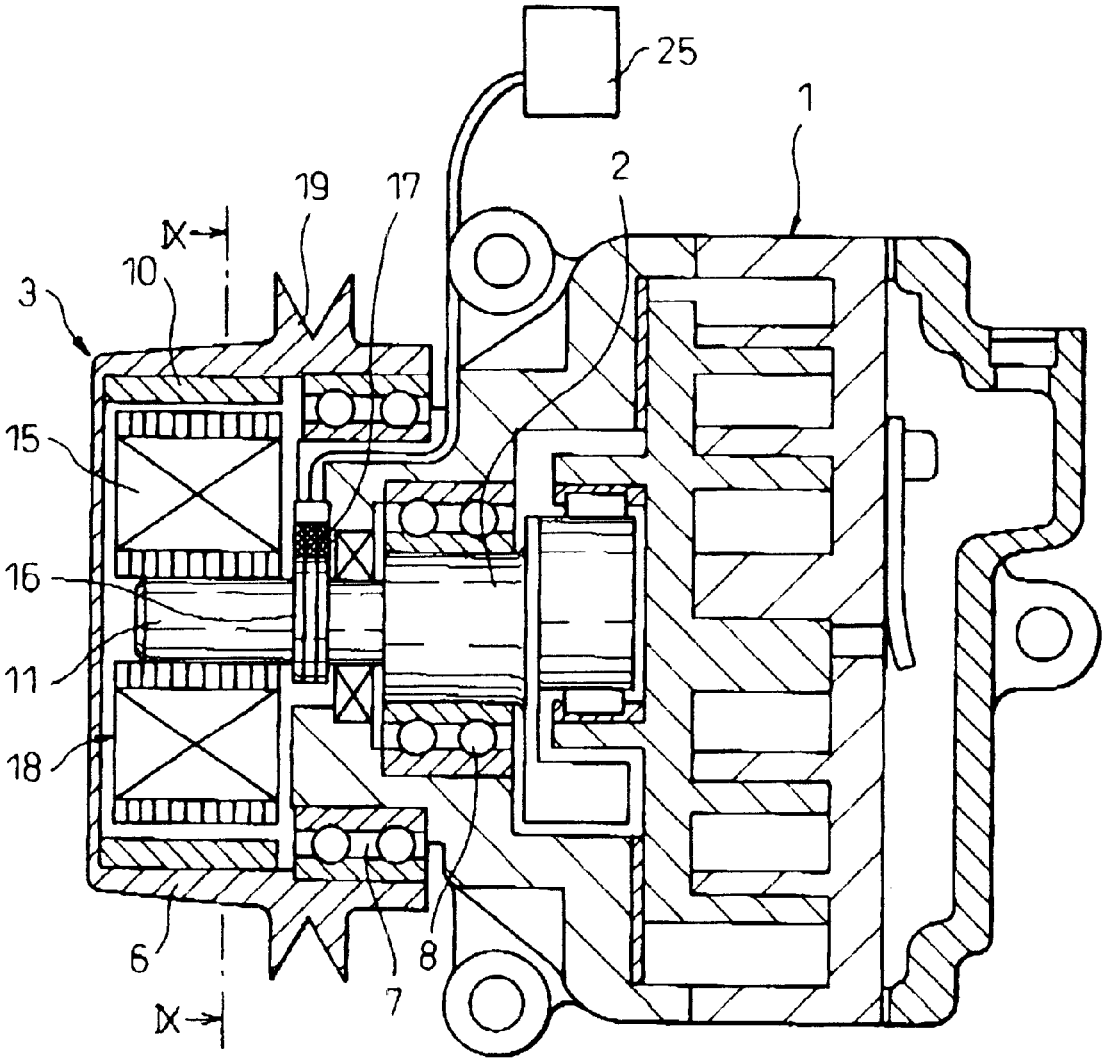
FIG. 8 is a longitudinal sectional view showing the essential parts according to a third embodiment of the invention.
Figure 9:
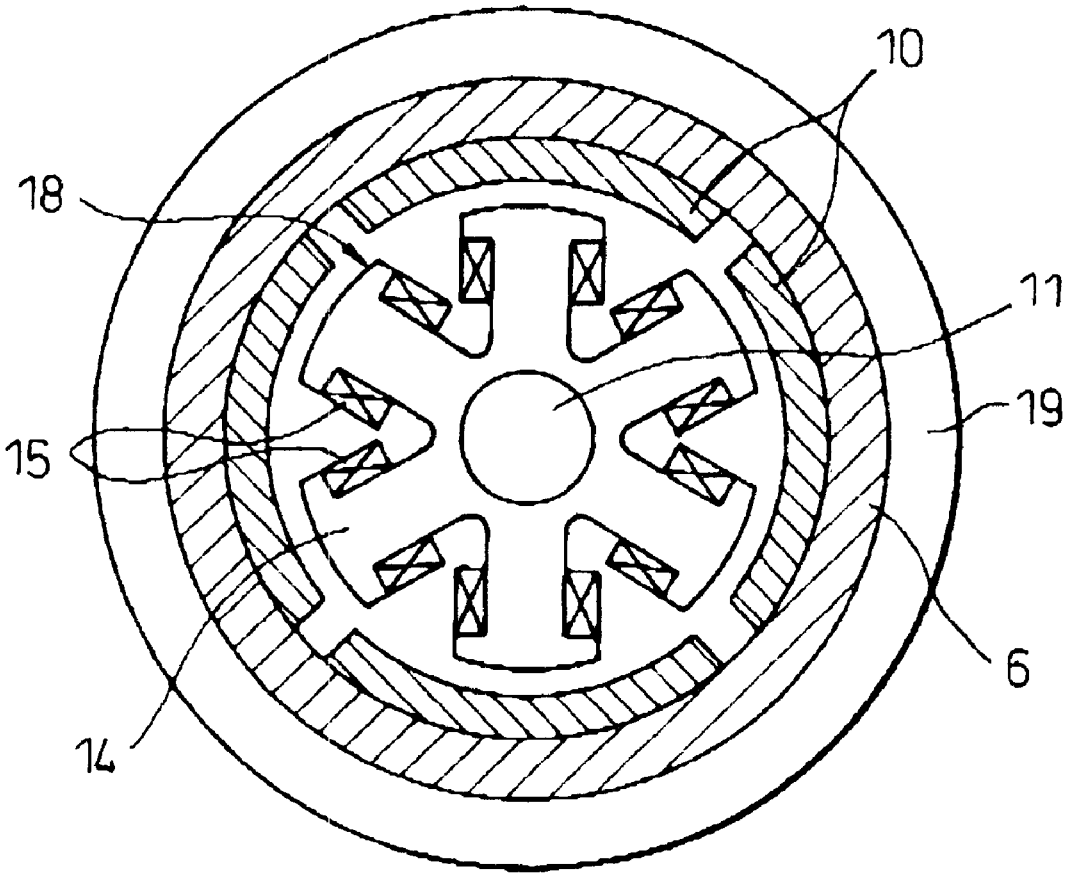
FIG. 9 is a cross sectional view of the essential parts taken in line IX—IX in FIG. 8.

FIGS. 8 and 9 show the essential parts of the composite drive system for the compressor according to a third embodiment of the invention. In the dynamotor 3, as in the second embodiment shown in FIG. 7, the field portion 6 makes up the input side and the armature portion 18 the output side. As shown in FIG. 4, the pulley 19 rotationally driven by the internal combustion engine 22 is formed integrally on the outer periphery of the field portion 6 doubling as the housing of the dynamotor 3. The diameter of the pulley 19 is larger than in the second embodiment. The other parts of the configuration are similar to, and have substantially similar functions and effects as, the corresponding parts of the first embodiment shown in FIGS. 1 and 2.

Figure 10:
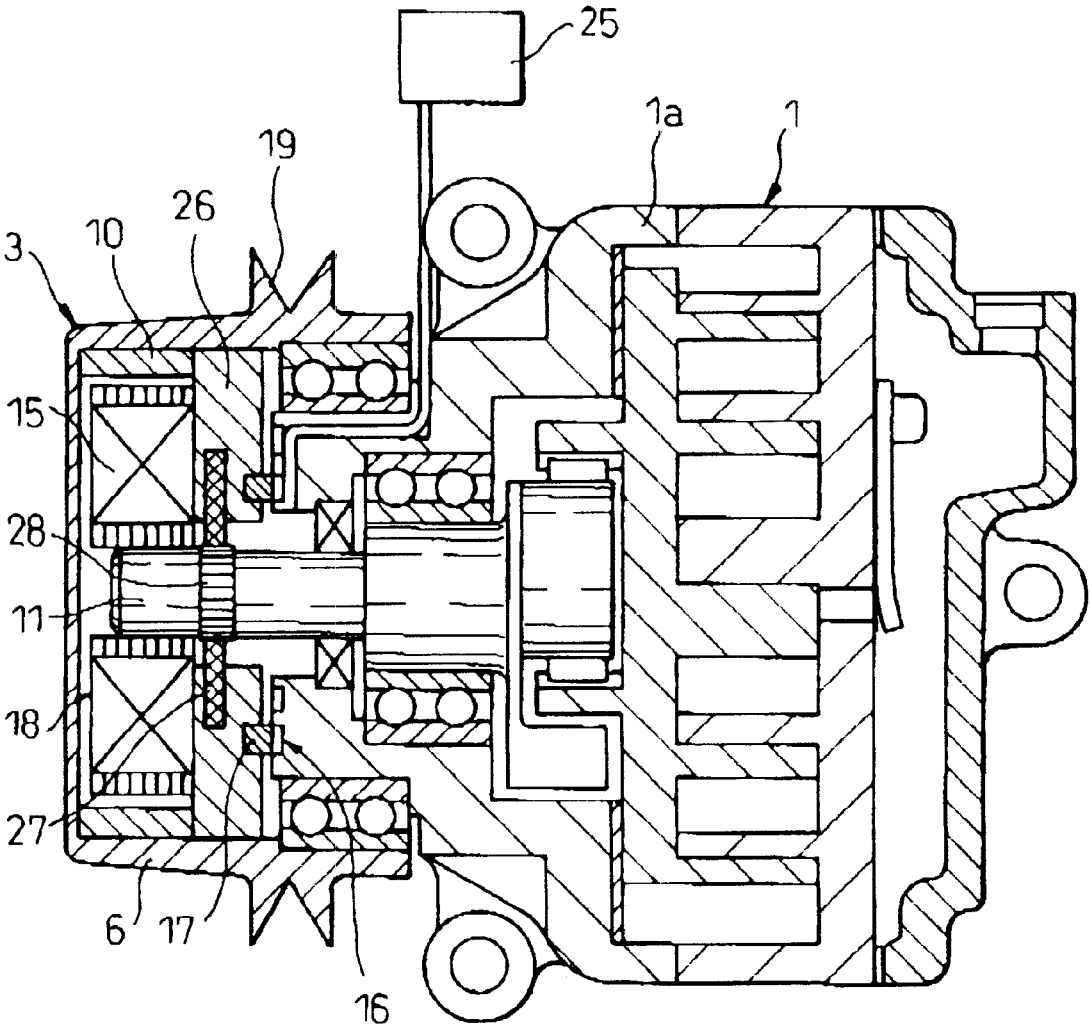
FIG. 10 is a longitudinal sectional view showing the essential parts according to a fourth embodiment of the invention.

FIG. 10 shows the essential parts of the composite drive system for the compressor according to a fourth embodiment of the invention. In this embodiment, the dynamotor 3 is of commutator type and is supplied with DC power for generating the DC power. In spite of the fact that the supplied power is direct current, this embodiment is similar to the third embodiment shown in FIG. 8 in that the permanent magnets 10 are mounted on the inner surface of the field portion 6 doubling as a housing and the coils 15 are arranged on the armature portion 18. Similarly, the pulley 19 is integrated with the field portion 6 making up the input side and the armature portion 18 makes up the output side.

The fourth embodiment is different from the third embodiment in that two concentric slip rings 16, inner and outer, are mounted on the end surface of the housing 1*a* of the compressor 1 through an insulating member and two corresponding brushes 17 are mounted on the insulating member 26 on the inner surface of the rotating field portion 6, that two other brushes 27 connected to the brushes 17 by a conductor not shown are arranged on the insulating member 26 in radially opposed relation to each other with the forward ends thereof in sliding contact with a plurality of commutators 28 mounted on the rotary shaft 11 through an insulating member, that a plurality of coils 15 are connected to the commutators 28, and that the contents of the circuits of the power control unit 25 are different.

As described above, according to the fourth embodiment, the dynamotor 3 is of commutator type and is supplied with DC power and therefore has the above-mentioned configurational difference with the third embodiment. Nevertheless, the basic features of the third and fourth embodiments are not different from each other. The fourth embodiment, therefore, basically has similar functions and effects to those of each embodiment described above. When the dynamotor 3 operates in motor mode, the DC power of the battery 24 is of course supplied as it is to the coils 15 through the power control unit 25 and the commutator 28. As long as the dynamotor 3 operates in generator mode, on the other hand, DC power is produced from the brushes 27 and therefore the power control unit only regulates the voltage thereof. Thus, the DC power is supplied to and stored in the battery 24 substantially as it is.

In each of the embodiments described above, the dynamotor 3 has permanent magnets 10 for purposes of simplifying and reducing the cost of the structure of the dynamotor 3. Therefore, the permanent magnets 10 may safely be replaced with electromagnets composed of a coil and an iron core. Also, in spite of the fact that the permanent magnets 10 are mounted on the field portion 6 in each of the embodiments described above, common knowledge about the motor and the generator indicates that the permanent magnets can be radially mounted on the armature portion 18 while at the same time arranging the coils on the field portion 6. Further, the power supplied to the dynamotor 3 from the power control unit 25 and produced from the dynamotor 3 may be the single-phase AC power instead of the three-phase AC or DC power unlike in the embodiments described above.

Figure 11:
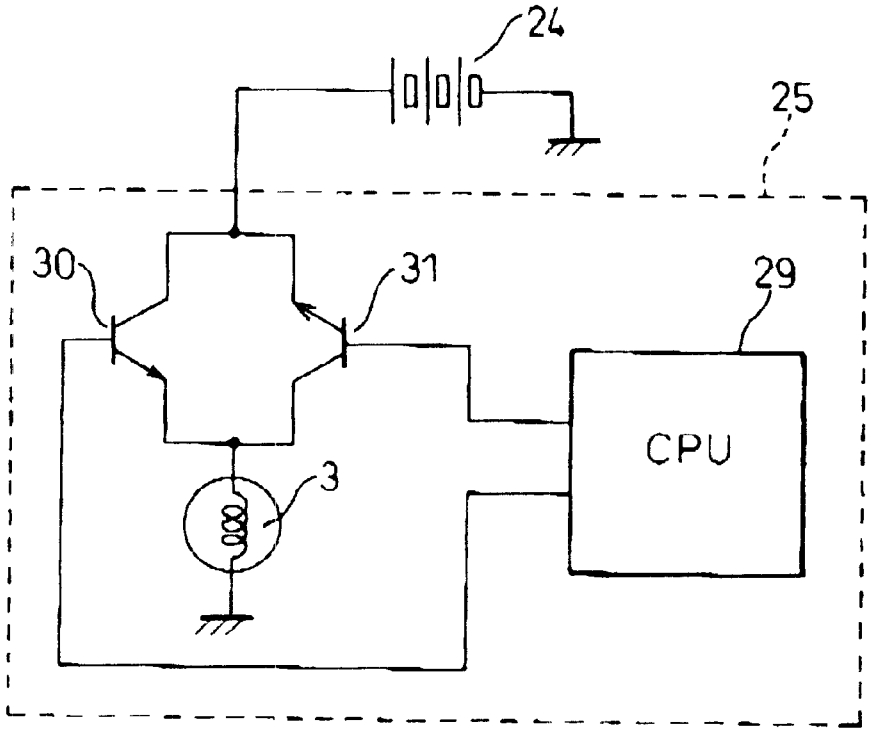
FIG. 11 is a circuit diagram illustrating the contents of a power control unit used for a DC dynamotor.
Figure 12:
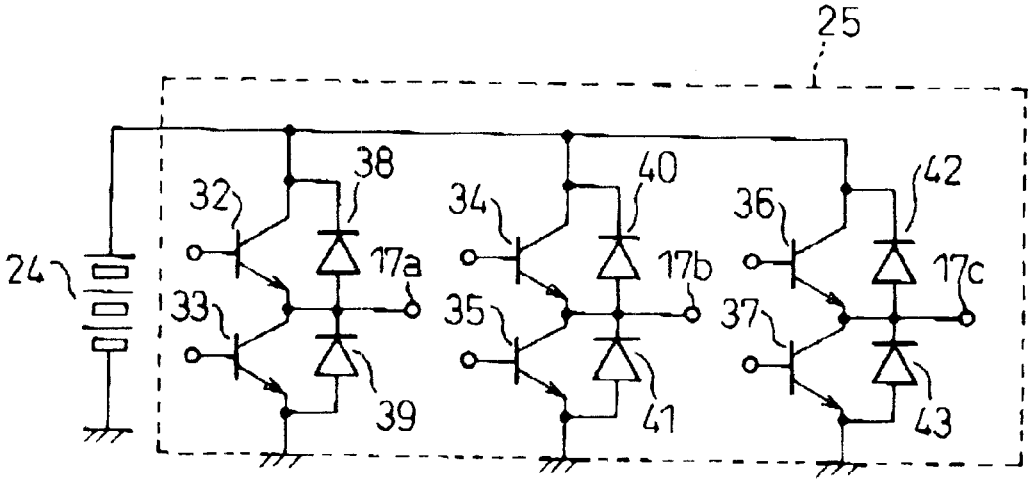
FIG. 12 is a circuit diagram illustrating the contents of a power control unit used for a three-phase AC dynamotor.

As is apparent from the configuration and the operation of the composite drive system for the compressor according to the embodiments of the invention described above, the power control unit 25 inserted between the dynamotor 3 and the battery 24, though varied by the type of the power supplied to the dynamotor 3, is basically required to have three functions including (1) the function of rotationally driving the dynamotor 3 as a motor, (2) the function of producing the power from the dynamotor 3 as a generator and supplying it to the battery 24, and (3) the function of operating the dynamotor 3 in an unloaded operation mode. Two examples of an electrical circuit incorporated in the power control unit 25 for achieving these functions are shown in FIGS. 11 and 12. These electrical circuits are controlled by a computer (CPU) 29 arranged inside or outside the power control unit 25. The CPU 29 performs the arithmetic operations based on the output signals of sensors for detecting the magnitude of the cooling capacity required of the air-conditioning system, the operating condition including the rotational speed and the stationary state of the internal combustion engine 22 or the storage capacity of the battery 24 or the built-in map data, etc., and outputs the required control signal to the electrical circuits in the power control unit 25.

FIG. 11 shows an example of a circuit of the power control unit 25 employed in the case where the dynamotor 3 is a DC machine. A pair of power transistors 30, 31 are connected in loop, and one of the two junction points is connected to the dynamotor 3 while the other junction point is connected to the battery 24. The base of each the transistors 30 and 31 is supplied with a control signal as a voltage from the CPU 29, and in accordance with the control signal, at least one of the two transistors 30, 31 is turned on, or both are turned off, at the same time. In the case where the dynamotor 3 is operated in motor mode, the transistor 30 is turned on. As a result, the DC power of the battery 24 is supplied to the dynamotor 3. The amount of the current is controlled by the transistor 30 in accordance with the magnitude of the voltage of the control signal, and therefore the discharge capacity of the compressor 1 can be controlled by changing the rotational speed ΔN of the dynamotor 3 steplessly.

Conversely, in the case where the dynamotor 3 is operated in generator mode, the transistor 31 is turned on by the CPU 29. As a result, the DC power generated by the dynamotor 3, which is now a generator, is supplied to and stored in the battery 24. The amount of this current can also be controlled steplessly by the transistor 31.

In the case where the compressor 1 is stopped, both the transistors 30 and 31 are turned off, resulting in the unloaded operation mode. The electrical circuit between the dynamotor 3 and the battery 24 is turned off, and no power is transmitted. Thus, the output side of the dynamotor 3 is deactivated, and the drive shaft 3 of the compressor 1 connected thereto is also stopped. It is not therefore necessary to use an electromagnetic clutch. The duty factor control operation can be performed by repeating the turning on/off between the disconnection in unloaded operation mode and the interlocked operation in generator mode or motor mode at short intervals of a short time.

FIG. 12 shows a circuit example of the power control unit 25 in the case where the dynamotor 3 is a three-phase AC machine. In this case, six power transistors 32 to 37 and six diodes 38 to 43 bridging the transistors, respectively, make up three circuits parallel to each other. These circuits are collectively connected to a battery 24. The base of each of the transistors 32 to 37 is impressed with a voltage as an independent control signal from the CPU 29. The three circuits include terminals 17*a*, 17*b*, 17*c*, respectively, which are connected to the three brushes 17 of the dynamotor 3 shown in FIG. 1, for example. The three brushes 17 in turn are connected to the coils 15 of the armature portion 18 through the three slip rings 16 in sliding contact therewith. The three slip rings 16 are shown as the slip rings 16*a* to 16*c* in FIG. 3.

As is apparent from the circuit configuration shown in FIG. 12, in the case where the dynamotor 3 is operated in motor mode, this circuit operates as an inverter circuit for converting the DC power of the battery 24 to the three-phase AC power in response to the control signal of the CPU 29. In the process, the amount of the current flowing in the three circuits can of course be controlled freely.

In the case where the dynamotor 3 making up the three-phase AC machine is operated in generator mode, on the other hand, the circuit shown in FIG. 12 operates as a rectifier circuit for converting the three-phase AC power generated in the dynamotor 3 to DC power. At the same time as the rectification, the amount of the current and the voltage applied to the battery 24 are also controlled.

Further, the three circuits shown in FIG. 12 can be turned off at the same time in compliance with an instruction from the CPU 29. As a result, not only the power cannot be supplied to the dynamotor 3 but also the power cannot be recovered. Thus, the dynamotor 3 is set in unloaded operation mode, so that the compressor 1 is stopped while the internal combustion engine 22 is running, or the unloaded operation mode and the generator mode are switched to each other at internals of a short time, thereby making it possible to perform the duty factor control operation as shown in FIG. 6.

Figure 13:
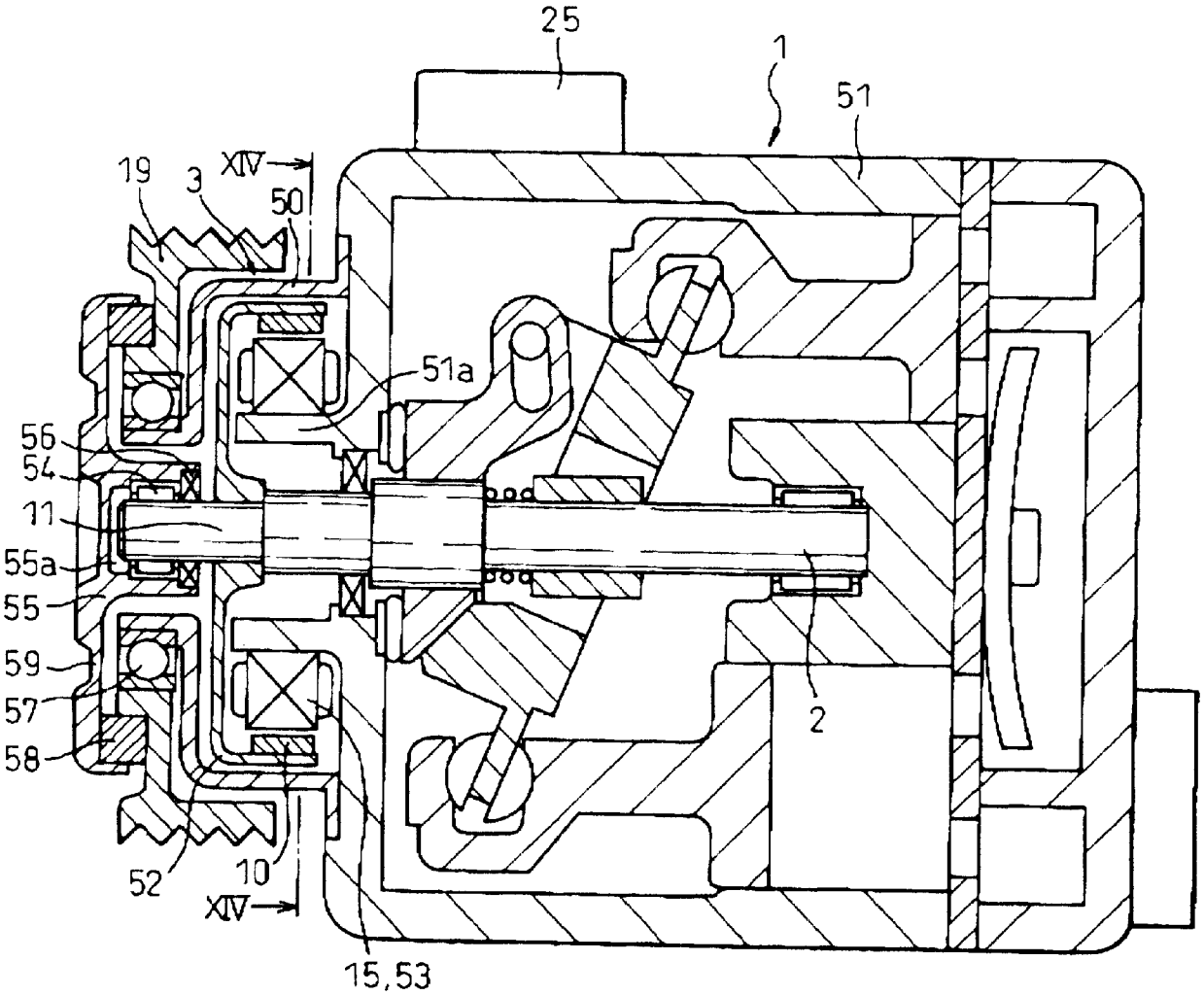
FIG. 13 is a longitudinal sectional view showing the essential parts according to a fifth embodiment of the invention.
Figure 14:
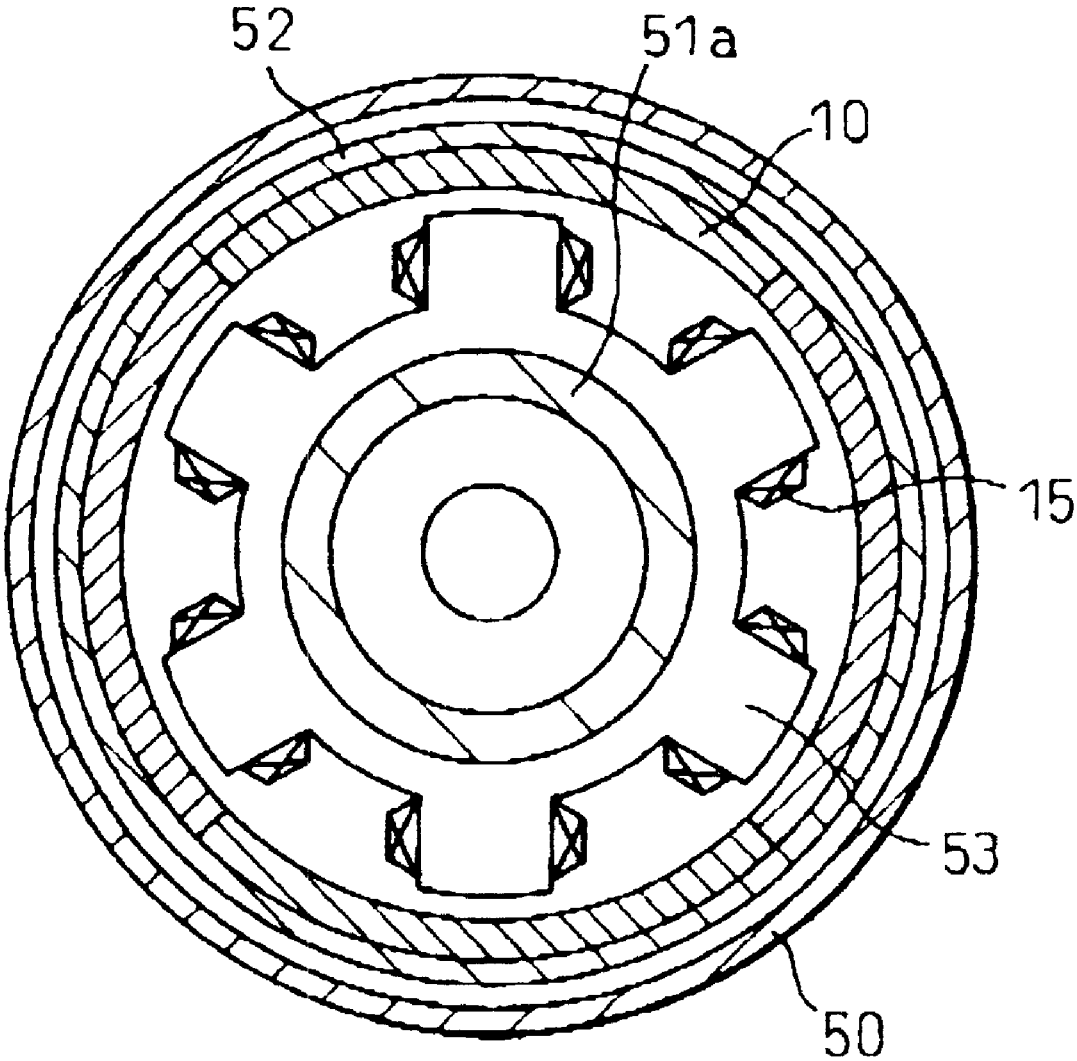
FIG. 14 is a cross sectional view of the essential parts taken in line XIV—XIV in FIG. 13.

FIGS. 13 and 14 show the essential parts of a composite drive system for the compressor according to a fifth embodiment of the invention. The dynamotor 3 according to the fifth embodiment is different from that of the embodiments described above in that the fifth embodiment includes a housing 50 fixedly mounted on the housing 51 of the compressor 1, that a rotatable rotor 52 in the shape of a deep dish is directly coupled to the rotary shaft 11, that a plurality of permanent magnets 10 are mounted on the inner peripheral surface of the rotor 52, and that a fixed iron core 53 made of a magnetic material having a plurality of radial protrusions as shown in FIG. 14 is mounted on the boss 51*a* formed to protrude axially from the housing 51 of the compressor 1 and the coils 15 are mounted on the protrusions, respectively.

Figure 15:
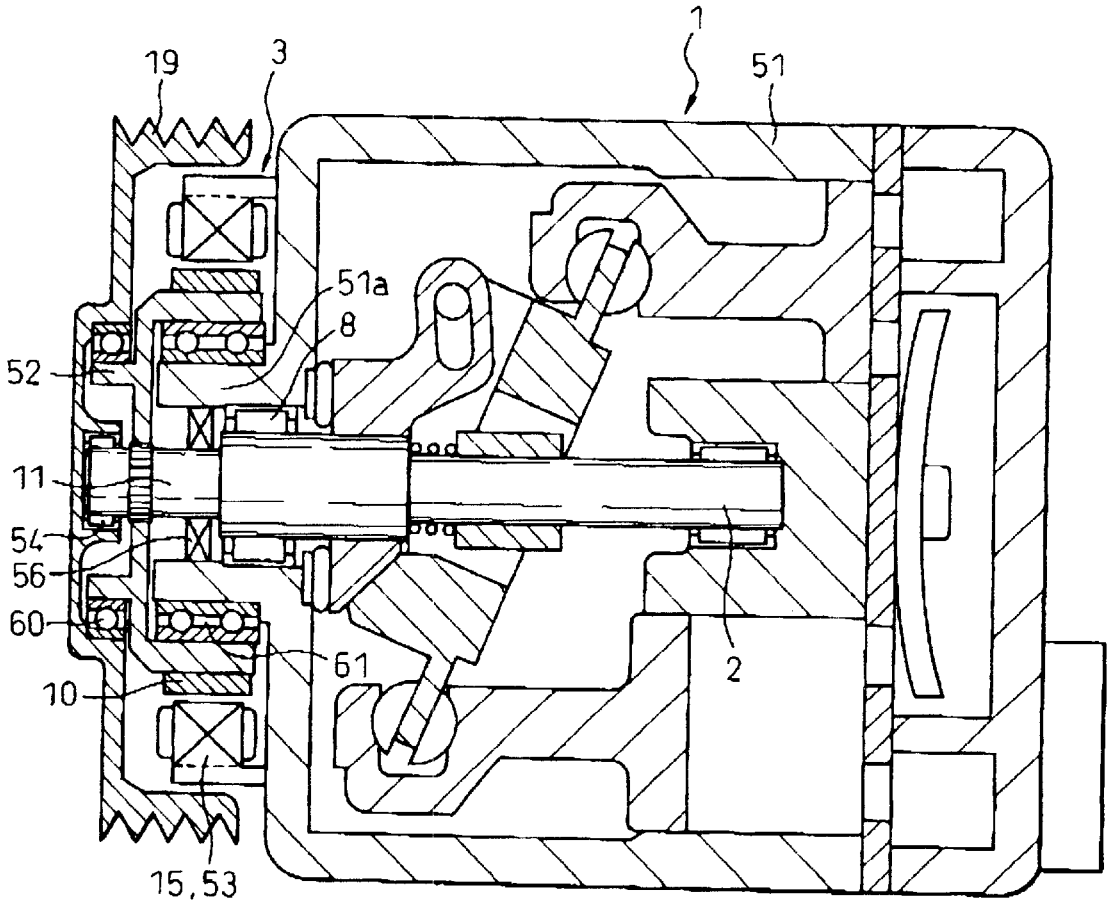
FIG. 15 is a longitudinal sectional view showing the essential parts according to a sixth embodiment of the invention.

These coils 15 are supplied, through wiring not shown, with the three-phase AC power from the inverter in the power control unit 25 shown in FIG. 15 to thereby generate a rotary magnetic field on the iron core 53. The inverter is supplied with the DC power from the battery 24. The rotary magnetic field of the iron core 53 rotates the rotor 52 having the permanent magnets 10, thereby rotationally driving the drive shaft 2 of the compressor 1. This is the operation in motor mode of the dynamotor 3 according to the fifth embodiment. In this case, the coils 15 are fixed together with the iron core 53, and therefore, as in each of the embodiments described above, the need is eliminated of the power feeding mechanism including the slip rings or the commutator and the brushes for supplying power to the coils 15.

A dish-shaped hub 55 is mounted on the rotary shaft 11 of the dynamotor 3 through a one-way clutch 54. The grease for lubricating the one-way clutch 54 is sealed hermetically in the cylindrical space 55*a* at the center of the hub 55 by a seal member 56. The pulley 19 is rotatably supported by the bearing 57 mounted on the housing 50 of the dynamotor 3 and, as shown in FIG. 4, rotationally driven by the internal combustion engine 22 through the belt 20. A damper 58 made of an elastic material such as rubber is interposed between the pulley 19 and the hub 55. Further, a part of the hub 55 is formed with an annular thin portion making up a torque limiter 59 adapted to break for cutting off the transmission of an excessive torque which may be imposed.

The dynamotor 3 according to the fifth embodiment can operate not only in motor mode, but also as a generator in the case where the pulley 19 is constantly driven rotationally by the internal combustion engine 22 and the rotor 52 is rotationally driven through the hub 55 and the one-way clutch 54. The three-phase AC power is produced to the power control unit 25 from the fixed coils 15, and after being rectified as described above, charged to the battery 24. This represents the operation of the dynamotor 3 in generator mode according to the fifth embodiment. When the system is in generator mode, only the lightweight rotor 52 having the permanent magnets 10 is rotated, and therefore a lesser load is imposed on the internal combustion engine 22 than for the normal alternator.

In each of the fifth and subsequent embodiments, the compressor 1 is a swash-plate compressor of a variable displacement type. However, this is only an example, and the compressor 1 is not limited to such type, but a variable displacement compressor of other types, or a compressor having a predetermined discharge capacity may be employed with equal effect. The structure and the operation of the swash-plate compressor of variable displacement type shown in the drawings are well known and therefore is not described herein.

The composite drive system for the compressor according to the fifth embodiment is configured as described above. In the case where the internal combustion engine 22 is stopped by the idle-stop control so that the compressor 1 is rotationally driven with the pulley 19 not in rotation, for example, the three-phase AC power is supplied to the coils 15 of the dynamotor 3 from the inverter in the power control unit 25. As a result, a rotary magnetic field is formed in the fixed iron core 53. Thus, the rotor 52 having the permanent magnets 10 is rotated thereby to rotationally drive the drive shaft 2 of the compressor 1 together with the rotary shaft 11. In this motor mode, the provision of the one-way clutch 54 can maintain the stationary state of such portions as the hub 55 and the pulley 19 on the side of the internal combustion engine 22. The rotational speed of the dynamotor 3 and hence the rotational speed and the discharge capacity of the compressor 1 can be freely changed by controlling the electric energy supplied to the dynamotor 3 using the power control unit 25. This control operation can be smoothly carried out by controlling the amount of supplied current according to the duty factor.

This dynamotor 3 can be operated always in generator mode as long as the internal combustion engine constituting a main drive source is rotated except in motor mode. The rotor 52 of the dynamotor 3 according to the fifth embodiment only supports a plurality of the permanent magnets 10, and therefore is lighter than the counterpart carrying the coils and the iron core. Therefore, the power loss of the rotor 52 is very small even when it is kept in rotation. In generator mode, the dynamotor 3 operates always as a generator and is constantly ready to charge the battery 24. In the case where the compressor 1 is a refrigerant compressor of the air-conditioning system, therefore, the dynamotor 3 can operate as a generator even in the cold winter season when the compressor 1 is not operated. The amount of the current flowing to the battery 24 can of course be controlled freely by the power control unit 25.

Should the compressor 1 including the composite drive system according to the fifth embodiment be locked, the torque limiter 59 portion of the hub 55 would be broken by the abnormally increased torque, and the belt 20 is prevented from breaking. Further, since a damper 58 is inserted between the hub 55 and the pulley 19, the torque change generated when the compressor 1 is driven is absorbed and the vibration can be damped.

FIG. 15 shows the essential parts of the composite drive system for the compressor according to a sixth embodiment of the invention. The portions shared by the fifth embodiment are designated by the same reference numerals, respectively, and will not be explained again. The features of the sixth embodiment as compared with the fifth embodiment lie in that in the absence of the housing of the dynamotor 3, the pulley 19 is rotatably supported by the rotating rotor 52 through the bearing 60, and that the rotor 52 is rotatably supported by the boss 51*a* formed on the housing 51 of the compressor 1 through the bearing 61.

According to the sixth embodiment, a plurality of the permanent magnets 10 are mounted on the outer peripheral surface of the cylindrical portion of the rotor 52, and therefore the iron core 53 having the coils 15 is mounted directly on the side surface of the housing 51 of the compressor 1 in opposed relation to the permanent magnets 10. The functions and effects of the sixth embodiment are substantially identical to those of the fifth embodiment.

Figure 16:
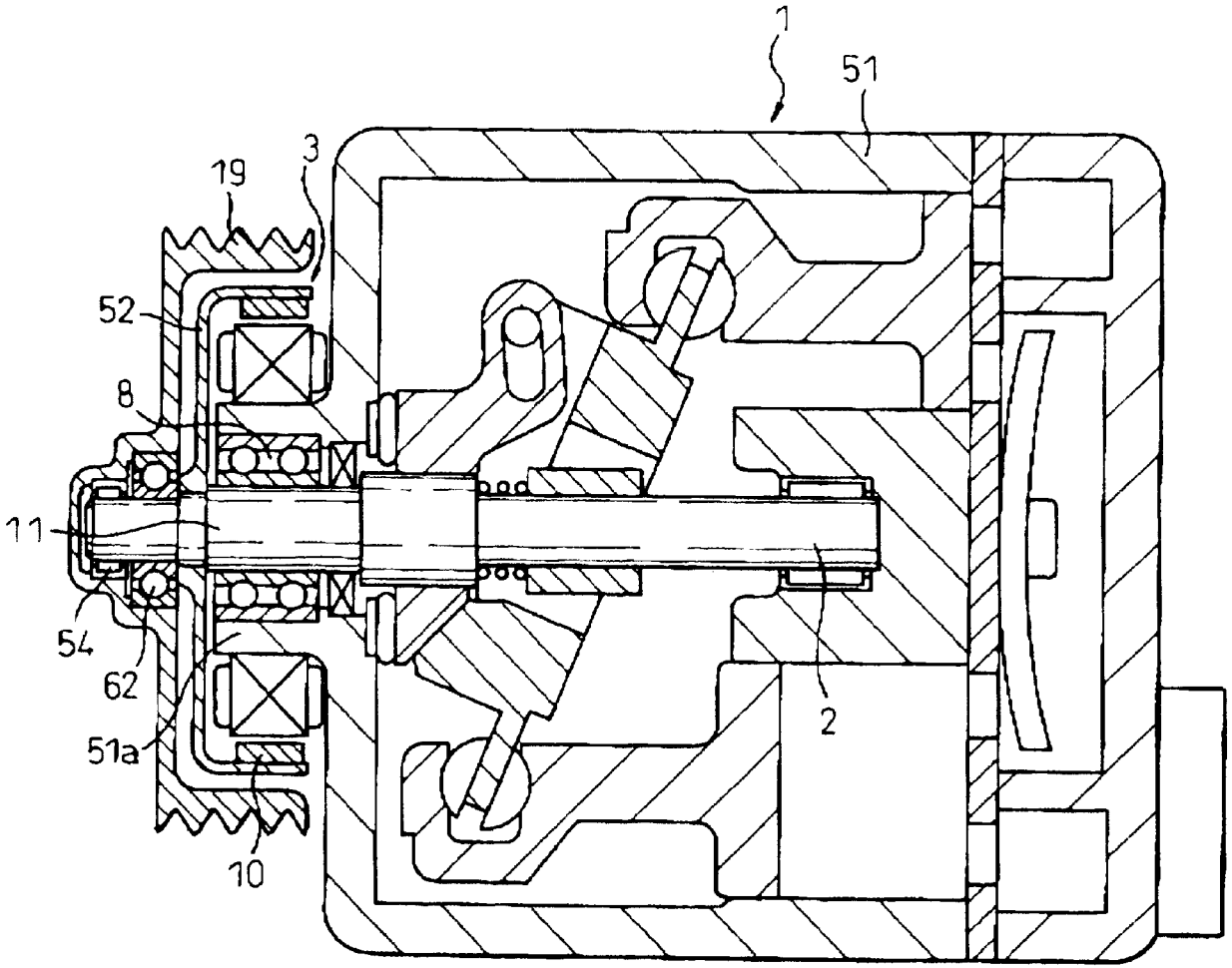
FIG. 16 is a longitudinal sectional view showing the essential parts according to a seventh embodiment of the invention.

FIG. 16 shows the essential parts of the composite drive system for the compressor according to a seventh embodiment of the invention. Comparison between the FIGS. 16 and 13 apparently shows that the seventh embodiment is different from the fifth embodiment in that according to the seventh embodiment lacking the housing 50 of the dynamotor 3, the pulley 19 is rotatably supported by the rotating rotary shaft 11 through the bearing 62. The rotary shaft 11 itself is rotatably supported by the boss 51*a* of the housing 51 through the bearing 8. The functions and effects of the seventh embodiment are substantially identical to those of the fifth embodiment.

Figure 17:
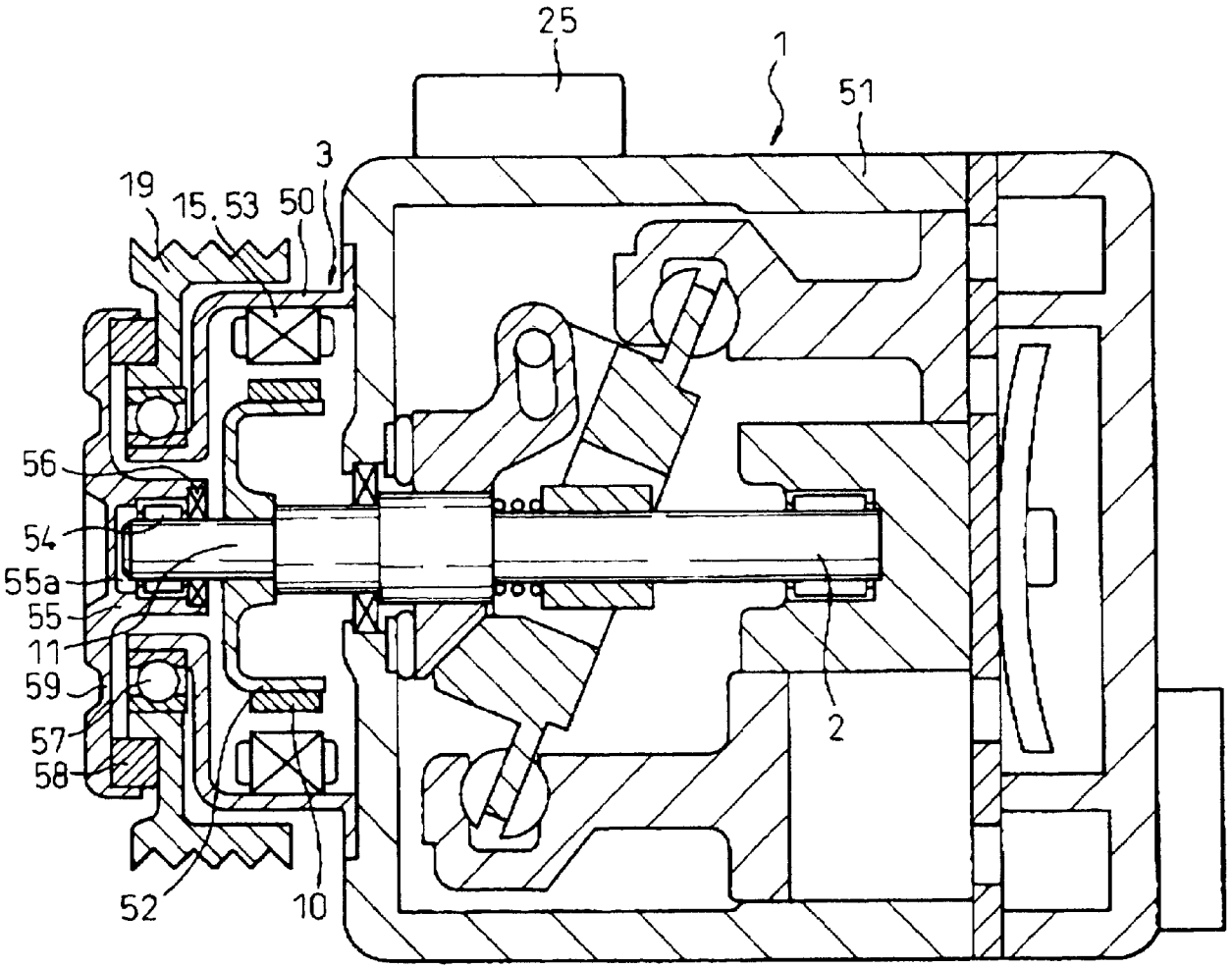
FIG. 17 is a longitudinal sectional view showing the essential parts according to an eighth embodiment of the invention.

FIG. 17 shows the essential parts of the composite drive system for the compressor according to an eighth embodiment of the invention. Comparison between FIGS. 17 and 13 apparently shows that the eighth embodiment is different from the fifth embodiment in that according to the eighth embodiment, the iron core 53 having a plurality of the coils 15 is arranged on the inner peripheral surface of the housing 50 of the dynamotor 3, and a plurality of the permanent magnets 10 are arranged on the inner peripheral surface of the rotor 52 in opposed relation to the iron core 53. The other points and the functions and effects are similar to the corresponding points of the fifth embodiment.

Figure 18:
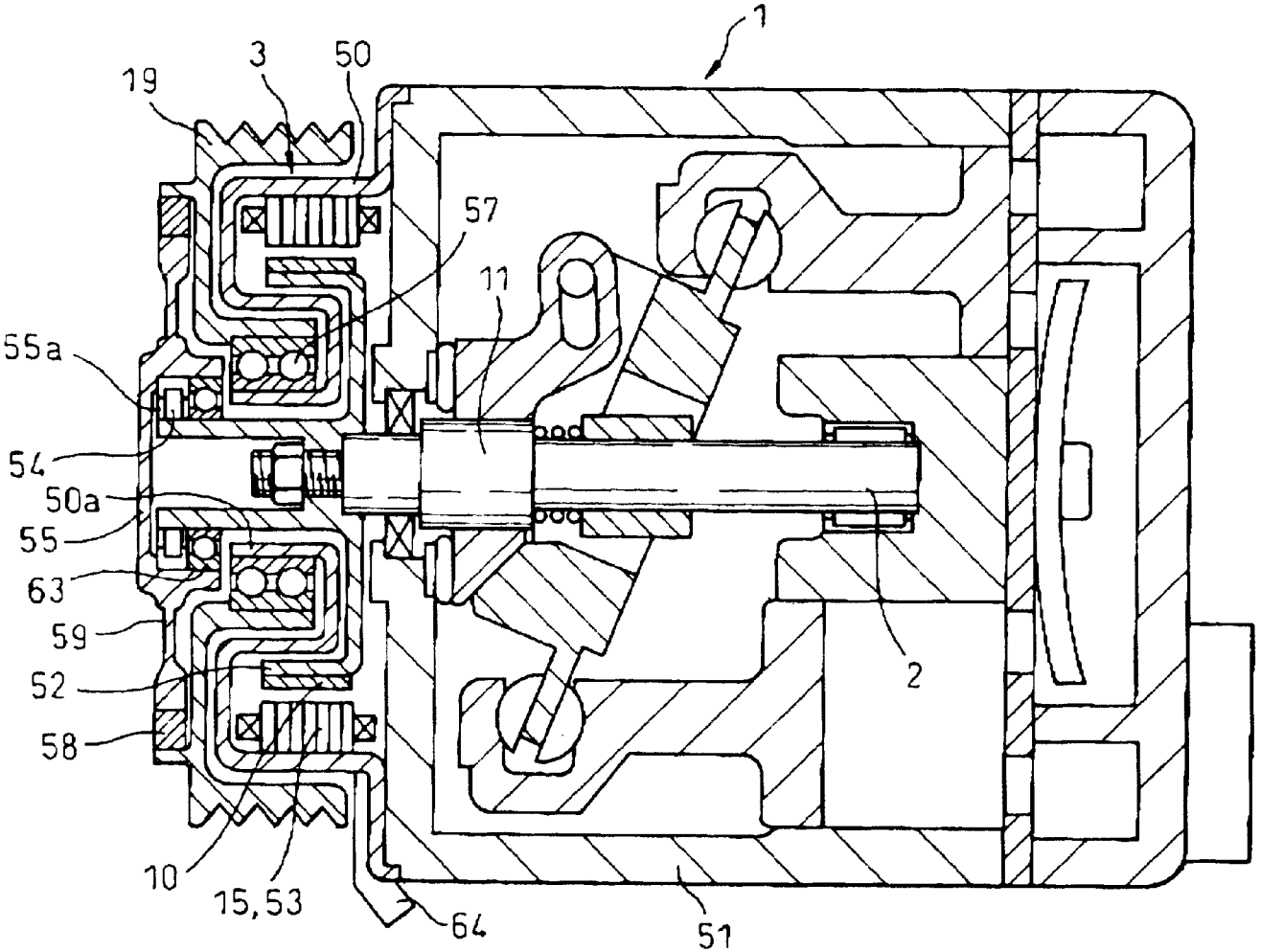
FIG. 18 is a longitudinal sectional view showing the essential parts according to a ninth embodiment of the invention.

FIG. 18 shows the essential parts of the composite drive system for the compressor according to a ninth embodiment of the invention. The features of the ninth embodiment lie in that the housing 50 of the dynamotor 3 covers the dynamotor 3 from the front portion thereof and then turning back toward the central portion of the dynamotor 3 followed by advancing back again forward, forms an end portion including a cylindrical portion 50*a* having a small diameter, and that the bearing 57 for rotatably supporting the pulley 19 is mounted on the outer surface of the cylindrical portion 50*a*. As a result, the axial length of the whole system can be shortened as compared with each of the embodiments described above.

The rotor 52 mounted on the rotary shaft 11 is shaped to allow for the arrangement of the bearing 57 of the pulley 19 and to circumvent rearward of the permanent magnets supported by the bearing 57. Also, the pulley 19 is so shaped as to cover the housing 50 of the dynamotor 3 from the front part thereof, in view of the fact that the bearing 57 supporting the pulley 19 is arranged in the dynamotor 3. The most of the pulley 19 is arranged rearward of the front end of the housing 50. Therefore, the dynamotor 3 and the pulley 19 and the bearing 63 for supporting the one-way clutch 54 and the hub 55 can also be arranged rearward, thereby contributing to a shorter axial length of the whole system.

According to the ninth embodiment, the one-way clutch 54 is arranged at the front end of the rotor 52, and the shield-type bearing 63 (including a shield member sealed with grease) is arranged behind the one-way clutch 54 thereby preventing the grease from leaking out of the one-way clutch 54. In the ninth embodiment, the coils 15 and the iron core 53 are mounted on the housing 50 of the dynamotor 3, and therefore the connector 64 for supplying power to the dynamotor 3 can be integrated with the housing 50, thereby simplifying the configuration.

Figure 19:
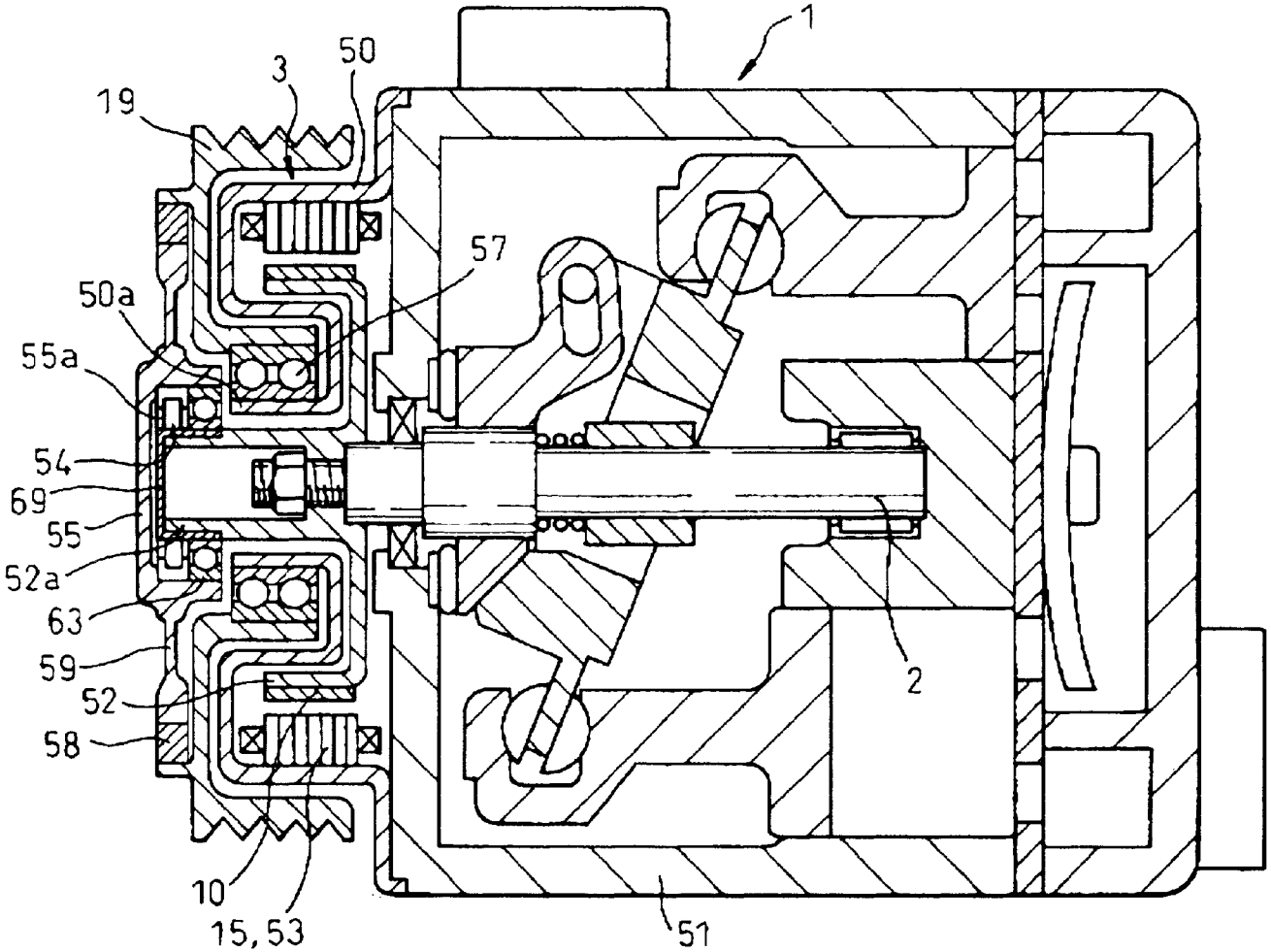
FIG. 19 is a longitudinal sectional view showing the essential parts according to a tenth embodiment of the invention.

FIG. 19 shows the essential parts of the composite drive system for the compressor according to a tenth embodiment of the invention. The feature of the tenth embodiment lies in that, unlike in the ninth embodiment according to which the one-way clutch 54 directly engages a part of the rotor 52, a collar 69 is provided as a member independent of the rotor 52. The collar 69 is fixed by, say, pressure fitting at the forward end of the cylindrical portion 52*a* at the central of the rotor 52. The collar 69, which is small and independent of the rotor 52, can be independently made of a high-class hard material or can be heat treated, and therefore the whole rotor 52 need not be fabricated of a high-class material. Also, there is no need of performing the complicated process such as the local heat treatment of only the portion of the rotor 52 engaging the one-way clutch 54.

Figure 20:
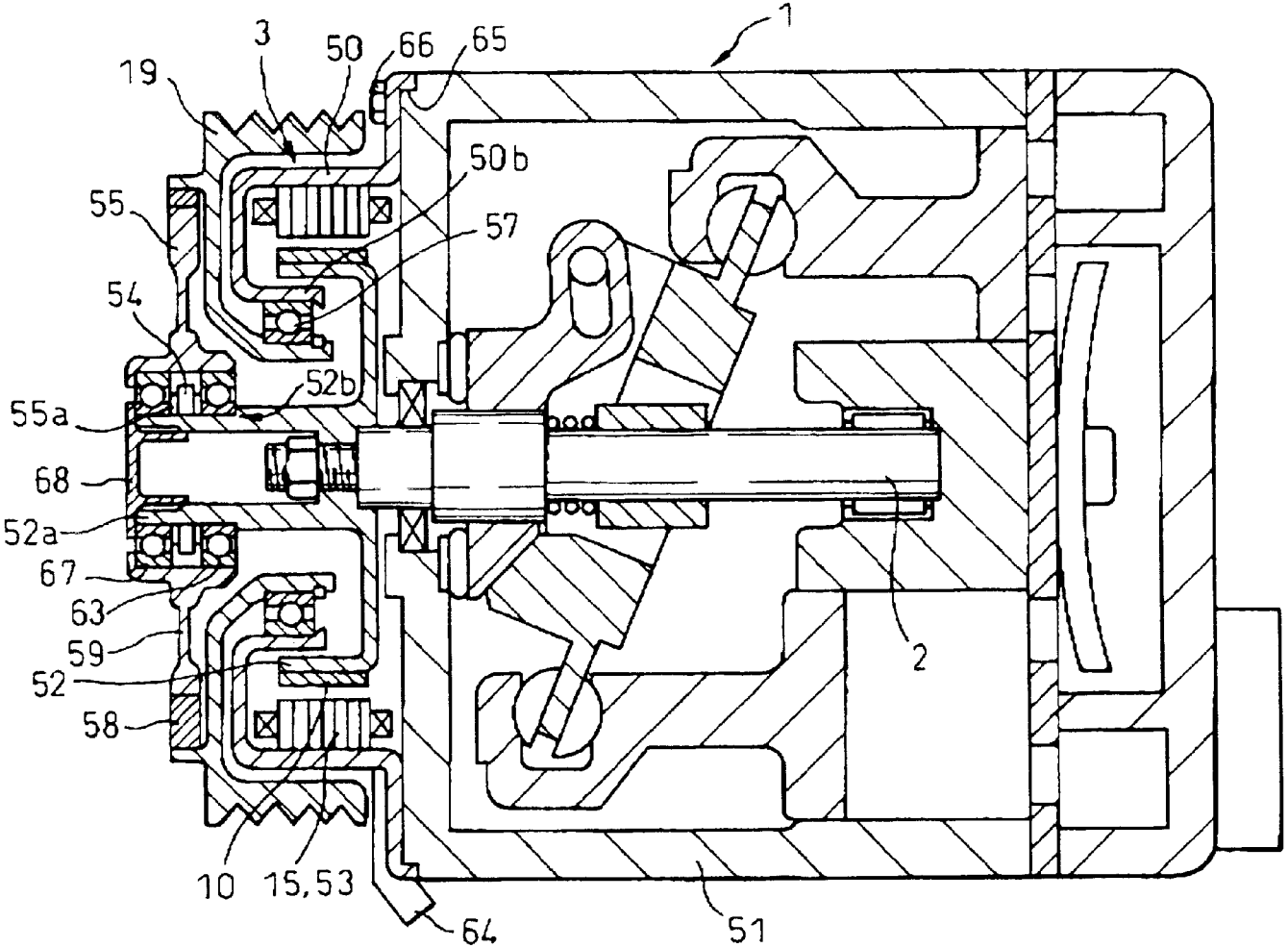
FIG. 20 is a longitudinal sectional view showing the essential parts according to an 11th embodiment of the invention.

FIG. 20 shows the essential parts of the composite drive system for the compressor according to an 11th embodiment of the invention. In this embodiment, the bearing 57 for the pulley 19 is supported differently from the ninth and tenth embodiments. In the ninth and tenth embodiments, the bearing 57 of the pulley 19 is supported on the outer surface of the end portion including the small-diameter cylindrical portion 50*a* formed to extend toward the central portion. In the 11th embodiment, on the other hand, the bearing 57 is supported on the inner surface of the large-diameter cylindrical portion 50*b* formed at the end portion of the housing 50 covering the dynamotor 3.

The configuration of the 11th embodiment can simplify the bearing structure of the pulley 19 and avoid the complicated shape of the housing 50 of the dynamotor 3. In the 11th embodiment shown in FIG. 20, for fixing the housing 50 of the dynamotor 3 firmly on the housing 51 of the compressor 1, a fitting portion 65 and bolts 66 are used. Also, in order to prevent the one-way clutch 54 from inclination, the one-way clutch 54 is supported on the two sides thereof by the bearings 63, 67. Further, for stopping the hub 55, the cover 68 of an independent structure is mounted at the forward end of the cylindrical portion 52*a* formed axially about the center of the rotor 52. Thus, the hub 55 is positioned axially on both sides of the bearings 63 and 67 between the cover 68 and the step 52*b* formed on the cylindrical portion 52*a*.

As described above, the ninth to 11th embodiments each have a feature, in the detailed structure, useful for actually designing the dynamotor 3 integrated with the compressor 1 driven by the internal combustion engine through the belt and the pulley 19 in the air-conditioning system or the like mounted on an automobile. Nevertheless, the basic functions and effects of these embodiments are substantially identical to those of the fifth embodiment.

What is claimed is:

1. A composite drive system for a compressor, comprising:

an input means receiving power from a prime mover constituting a main drive source;

a dynamotor capable of operating as selected one of a motor and a generator, including an armature portion capable of being rotated and a field portion surrounding said armature portion and supported to rotate independently of said armature portion;

a compressor having a drive shaft for compressing a fluid when said drive shaft is rotationally driven;

a power supply unit capable of supplying power to said dynamotor and capable of receiving the power supplied from said dynamotor;

a power control unit incorporated in an electrical circuit for connecting said power supply unit and said dynamotor;

means for mechanically interlocking a selected one of the armature portion and the field portion of said dynamotor with said input means; and means for mechanically interlocking the other one of the armature portion and the field portion of said dynamotor with the drive shaft of said compressor.

2. A composite drive system for a compressor according to claim 1, wherein at least one permanent magnet is mounted on selected one of the field portion and the armature portion, wherein an iron core having a plurality of coils is mounted on the other one of said field portion and the armature portion, and wherein a plurality of said coils are each energized thereby to form a rotary magnetic field in said iron core.

3. A composite drive system for a compressor according to claim 1, wherein in order to stop said compressor and reduce the discharge capacity of said compressor to zero, the electrical circuit connecting said dynamotor and said power supply unit is turned off by said power control unit to thereby reduce to zero the amount of the current flowing between said dynamotor and said power supply unit.

4. A composite drive system for a compressor according to claim 1, wherein said dynamotor operates in selected one of motor mode and unloaded operation mode when said prime mover is stationary, and wherein said dynamotor operates in selected one of motor mode, generator mode and unloaded operation mode when said prime mover is in operation.

5. A composite drive system for a compressor according to claim 1 wherein, in order to control the discharge capacity per unit time of said compressor by controlling the rotational speed of the drive shaft of said compressor, the generator mode for supplying power to said power supply unit from said dynamotor is selected and the prevailing current amount is controlled by said power control unit.

6. A composite drive system for a compressor according to claim 5, wherein the current amount is controlled by a duty factor control operation performed by said power control unit.

7. A composite drive system for a compressor according to claim 1, wherein said prime mover is an internal combustion engine mounted on a vehicle.

8. A composite drive system for a compressor according to claim 1, wherein said compressor is of fixed replacement type having a predetermined discharge capacity per rotation of said drive shaft.

9. A composite drive system for a compressor according to claim 1, wherein said compressor is used as a refrigerant compressor of an air-conditioning system of a vehicle.

10. A composite drive system for a compressor according to claim 1, wherein said power supply unit is a battery mounted on a vehicle.

11. A composite drive system for a compressor according to claim 1, wherein to control the discharge capacity per unit time by controlling the rotational speed of the drive shaft of said compressor, the motor mode for supplying power to said dynamotor from said power supply unit is selected and the prevailing current amount is controlled by said power control unit.

12. A composite drive system for a compressor according to claim 11, wherein the current amount is controlled by a duty factor control operation performed by said power control unit.

13. A composite drive system for a compressor according to claim 1, wherein said dynamotor is incorporated in the pulley as said input means rotationally driven through a belt from the output shaft of said prime mover.

14. A composite drive system for a compressor according to claim 1, wherein said dynamotor is mounted as a main generator on a vehicle.

15. A composite drive system for a compressor according to claim 1, wherein said prime mover is an internal combustion engine and subjected to idle-stop control.

16. A composite drive system for a compressor, comprising:

an input means receiving power from a prime mover constituting a main drive source;

a dynamotor capable of operating as selected one of a motor and a generator, including a rotor capable of rotating and having a plurality of permanent magnets arranged on the peripheral surface thereof and an iron core having a plurality of coils and fixed at a position in opposed relation to said rotor;

a compressor having a drive shaft for compressing a fluid when said drive shaft is rotationally driven;

a power supply unit capable of supplying power to said dynamotor and capable of receiving the power supplied from said dynamotor;

a power control unit incorporated in an electrical circuit for connecting said power supply unit and said dynamotor;

means for mechanically interlocking the rotor of said dynamotor with said input means; and means for mechanically interlocking the rotor of said dynamotor with the drive shaft of said compressor.

17. A composite drive system for a compressor according to claim 16, wherein said means for mechanically interlocking the rotor of said dynamotor and said input means includes a one-way clutch.

18. A composite drive system for a compressor according to claim 17, wherein said one-way clutch is arranged in a cylindrical space with one end closed and the other end open, and wherein said open other end is closed by a seal member and grease is sealed in said cylindrical closed space.

19. A composite drive system for a compressor according to claim 18, wherein said means for mechanically interlocking the rotor of said dynamotor and said input means includes a torque limiter.

20. A composite drive system for a compressor according to claim 16, wherein said means for mechanically interlocking the rotor of said dynamotor and said input means includes a damper for absorbing torque variations.

21. A composite drive system for a compressor according to claim 9, wherein said means for mechanically interlocking said rotor of said dynamotor and said input means includes a dish-shaped hub supported on said rotor through a bearing, and wherein the axial position of said hub is determined by means for setting said bearing in position on said rotor.

22. A composite drive system for a compressor according to claim 20, wherein said means for mechanically interlocking said rotor of said dynamotor and said input means includes a dish-shaped hub supported on said rotor through a bearing, and wherein said hub is positioned axially through said bearing by means mounted at an end portion of said rotor.

23. A composite drive system for a compressor according to claim 16, wherein said dynamotor operates in motor mode when said prime mover is stationary, and in generator mode always when said prime mover is in operation.

24. A composite drive system for a compressor according to claim 16, wherein said dynamotor is covered with a fixed housing.

25. A composite drive system for a compressor according to claim 24, wherein a connector for supplying power to said dynamotor is mounted on the housing of said dynamotor.

26. A composite drive system for a compressor according to claim 24, wherein an end portion of said housing of said dynamotor is fitted on a part of said housing of said compressor and fixed by fastening means.

27. A composite drive system for a compressor according to claim 16, wherein said means for mechanically interlocking the rotor of said dynamotor and said input means includes a pulley for a belt, and wherein said pulley is rotatably supported through a bearing by the drive shaft of said compressor.

28. A composite drive system for a compressor according to claim 16, wherein said means for mechanically interlocking the rotor of said dynamotor and said input means includes a pulley for a belt, and wherein, to support the tension of said belt exerted on said pulley, a housing of said dynamotor fixed to cover said dynamotor supports said pulley on the inside of said pulley.

29. A composite drive system for a compressor according to claim 28, wherein said housing of said dynamotor is configured to support a bearing of said pulley at an end portion located on inside of said dynamotor, and a portion of said housing that is radially outward of said end portion covers said dynamotor.

30. A composite drive system for a compressor according to claim 29, wherein said bearing of said pulley is supported on an outer surface of the end portion of said housing.

31. A composite drive system for a compressor according to claim 29, wherein the end portion of said housing supporting the bearing of said pulley is formed such that the housing extends over a front end of said dynamotor, then towards a rearward end of said compressor, and then towards the front end of said compressor, as viewed from a radially outward position to a radially inward position of said housing.

32. A composite drive system for a compressor according to claim 29, wherein said bearing of said pulley is supported on the-an inner surface of the end portion of said housing.

33. A composite drive system for a compressor according to claim 29, wherein the end portion of said housing supporting the bearing of said pulley is formed such that the housing extends over a front end of said dynamotor and then extends towards a rear end of said compressor, as viewed from a radially outward position to a radially inward position of said housing.

34. A composite drive system for a compressor according to claim 16, wherein said rotor is shaped such that a housing, which covers a front end of said dynamotor and then extends in a rearward direction of said compressor, is covered by said rotor from a rear portion of said housing.

* * * * *